US006289909B1

(12) United States Patent
Wood

(10) Patent No.: US 6,289,909 B1
(45) Date of Patent: Sep. 18, 2001

(54) INSTANT BOAT GARAGE

(76) Inventor: Thomas James Wood, 8365 Balboa Blvd. Apt. 13, Northridge, CA (US) 91325-4074

( * ) Notice: Subject to any disclaimer, the term of this patent is extended or adjusted under 35 U.S.C. 154(b) by 0 days.

(21) Appl. No.: 09/548,380

(22) Filed: Apr. 15, 2000

(51) Int. Cl.[7] ..... E04H 15/36

(52) U.S. Cl. ..... 135/124; 135/123; 135/138; 135/143; 135/146

(58) Field of Search ..... 135/124, 121, 135/123, 138, 115, 143, 146; 52/86

(56) References Cited

U.S. PATENT DOCUMENTS

| | | | |
|---|---|---|---|
| Re. 30,044 | | 7/1979 | Huddle . |
| 3,800,814 | | 4/1974 | Hibbert . |
| 3,855,643 | | 12/1974 | Hibbert . |
| 3,909,993 | | 10/1975 | Huddle . |
| 3,970,096 | | 7/1976 | Nicolai . |
| 4,091,584 | | 5/1978 | Brown . |
| 4,404,980 | | 9/1983 | Wade . |
| 4,739,784 | * | 4/1988 | Fast ..... 135/117 |
| 5,333,421 | * | 8/1994 | McKenna ..... 52/86 |
| 5,335,684 | | 8/1994 | Hanninen . |
| 5,573,026 | | 11/1996 | Griffith . |
| 5,595,203 | | 1/1997 | Espinosa . |

* cited by examiner

*Primary Examiner*—Beth A. Stephan
(74) *Attorney, Agent, or Firm*—Albert O. Cota

(57) ABSTRACT

A mobile stressed arched shelter in the form of a tunnel that stands freely. The shelter is assembled by bending straight pipes to opposite sides of two parallel base legs. The base legs are held together by flat straps and are covered by a tarp. Openings and closings at each end of the shelter utilize folds in the tarp. The frame is made of PVC pipe providing mobility and size variations by adding or subtracting segments. The legs have bendable hinges allowing the structure to form over irregular terrain's. The base legs may be broken down for mobility. By mix matching components numerous shapes could be made and more than one shelter could be connected side by side to form multiple car garages.

10 Claims, 17 Drawing Sheets

INSTANT BOAT GARAGE

CROSS-REFERENCE TO RELATED APPLICATIONS

This patent application has the legal right to the benefits of Disclosure Document Program under Disclosure Document No. 461626 filed Sep. 3, 1999,

BACKGROUND

1. Field of Invention

My invention relates to boat, car, and multipurpose shelters specifically shelters that keep a car or boat protected from weathering elements.

2. Description of Prior Art

Originally, boat shelters were made to fit on flat ground. Rough terrain would cause the shelter to rock back and forth.

Prior art boat shelters have straight bases, that don't bend to fit the contours of the earth. U.S. Pat. No. 5,595,203 to Espinosa (1997) discloses base legs that are made from plastic pipe. These base legs can't contour to ruts, grooves, or small hills without causing the shelter to rock on uneven land which prevents stability of the shelter.

Another problem with prior art is that sufficient open or closed ends of the entrance or exit of the shelter haven't been designed all on a one-piece tarp. U.S. Pat. No. 5,595,203 to Espinosa (1997) limits the customer's choice of openings in the shelter. The tarp is connected around the shelter in a fixed position leaving both ends open. U.S. Pat. No. 4,404,980 to Wade (1983) has two open ends and no means to close either of those ends. The problem with having any open end is that it diminishes from the overall protection the shelter provides to what's parked or stored inside.

Another problem with entrances and or exits of shelters is that they are blocked partially by extra support pipes or wires. This prevents the customer from driving in and out from either end of the shelter. What if the customer desires to drive in one end and out the other so he doesn't have to hassle with reversing. U.S. Pat. No. 4,091,584 to Brown (1978) has pipes vertical to the ground directly blocking any entrance or exit to the shelter. In order to protect a boat, the shelter would have to literally be built around the boat or picked up and placed over the boat. U.S. Pat. No. 5,595,203 to Espinosa (1997) limits the customer's choice of openings in the shelter because on of the ends is blocked by support wires.

A further problem with prior art is that the support bars that run down the length of the shelter, to hold the arches from swaying, are locked into permanent position and are a prescribed amount. The problem with having horizontal support pipes permanently placed is that the customer has to spend extra money that could have been saved if he or she lives in a mild climate and the extra support pipes aren't needed. However, if he or she lives in an extreme climate, additional support pipes can be invested in.

U.S. Pat. No. 5,595,203 to Espinosa (1997) illustrates the support bars being held in a set position by connectors that are permanently positioned. This can also be seen in U.S. Pat. No. 4,091,584 to Brown (1978) where the only horizontal support pipe is permanently held into position with holes that other pipes are inserted and locked into place.

Another problem with arched shelters is that most arched shelters aren't stable on their own To hold the arches in place, prior art either holds the shape of the arches by the use of stakes in the ground, using cross-pipes that a tire has to hop over, or a series of wires that connect the two parallel base legs along various points.

U.S. Pat. No. 4,404,980 to Wade (1983) uses stakes at the base of each arch. The stakes have to be burrowed into the ground and could lose hold on soft soil or not dig into hard dirt or rock. U.S. Pat. No. 4,091,584 to Brown (1978) has a pipe that lays flat on the ground that the tires have to hop over. U.S. Pat. No. 5,545,203 to Espinosa (1997) has wires that hold the bends of the arches together that connects from one end of each arch to the other. The metal wire can snap up and injure somebody or cause damage to a vehicle if it rusted and snapped. Also, if the shelter were placed over a rut that a wire ran across, the wire then could whip up by running over it with a tire since it has tension.

Another problem that could exist in prior art is metal connectors such as braces, brackets, nuts or bolts, on the inside of the shelter which can scrape the paint off a vehicle such as a boat or car if the vehicle accidentally rubs the shelter.

A further problem that exists with most prior art shelters is lack of an easy method of disassembly into small enough components to relocate easily.

A further problem with prior art is that the manufacturer has to find ways to make new components that don't already readily exist in the market. This could make it difficult to for the customer to replace a part if the company goes out of business.

An additional problem with prior art is that there isn't a way to line up one shelter next to another and lock it into position to have a two or more car garage. U.S. Pat. No. 5,595,203 to Espinosa (1997) doesn't give a customer a means to connect more than one shelter juxtaposing each other in a fixed position. If two or more shelters weren't linked somehow, they could drift apart if they were bumped and the customer would always find him or herself lining them back up again.

Another problem with prior art is that they can be fixed in size and can't be added to if a customer upgrades the size of his or her boat. Conversely they can be fixed so they can't be reduced in size.

A further problem with prior art is that they can be fixed in shape so that a customer couldn't change it using the same components or a few extra of the same components in some cases. For example he or she couldn't change a long arched tunnel into a dome.

One more problem with prior art is that some lack an efficient way to weigh down the shelter in high winds.

All boat or car shelters heretofore known suffer from a number of one or more disadvantages:

a.) They have base legs that are stiff and designed to sit on flat ground. If the ground has hills, ruts, or grooves, the shelter could tilt or rock back and forth or have instability.

b.) They have openings and closings for entrances and exits that haven't been designed for use on a one-piece tarp. Instead, there are permanently fixed openings or a separate unit has to be specially designed for a closing.

c.) They have entrances or exits partially blocked by wires or pipes for additional support. This prevents the vehicle from driving in one end and out the other.

d.) They have horizontal support pipes that are locked into fixed position and can't be subtracted or added to the shelter. This could cost the customer more money than necessary if he or she lived in a mild climate and didn't need the extra support. Most boat shelter manufacturers fix too many horizontal support pipes than are needed. The customer then doesn't have a choice on what he needs to spend based on climate.

e.) They aren't stable on their own. To keep the arches in a fixed position, prior art uses stakes in the ground. Stakes can't be burrowed into rock or hard ground. They also won't be stable in soft soil.

f.) They have cross-pipes to hold the arches that run along the ground and a tire would have to hop over.

g.) They use cross wires that run along the ground and hold the arches in position. Cross wires can be dangerous if they run across a rut and a tire whips it up. They can chip paint they snap against the bottom of the vehicle. They can also rust and snap and cause injury.

h.) They use metal connectors such as braces, brackets, nuts or bolts, that can accidentally scrape paint on a vehicle.

i.) They are hard to disassemble and pack up if the customer wanted to relocate.

j.) They have specialized parts that can't already be found on the market. This could make it hard for a customer if he or she needs to replace a component and the company went out of business.

k.) They have specialized parts so if a part breaks the customer has to specially order a new part rather than finding it in a local hardware store.

l.) They don't offer a means to line up more than one shelter to form a two or more car garage. Furthermore, in prior art, if a customer had two or more shelters lined up side by side without means of attachment, he or she would have to realign the shelters if one got bumped or knocked out of place.

m.) They are fixed in size so that a customer can't add on or subtract from his or her shelter.

n.) They are fixed in shape so a customer couldn't create additional shapes using the same components or sometimes a few more of the same components.

o.) They come without devices to weigh down the shelter in high winds.

SUMMARY

My invention, an instant boat garage, is made up of legs that contour to the earth's terrain, including one tarp that gives the customer the choice of any combination of openings and closings in the shelter's entrances and exits, in the preferred embodiment, using certain folding methods, arches held in place by flat straps that run along the ground and a tire can run over smoothly, means to make a two or more car garage, parts that can be found on the local market if replacement is needed, extra support pipes that don't come included to save customers money who don't need additional support, a means to readjust the size and shape of the shelter at any time, components on the inside of the shelter that make it hard to scratch paint off a vehicle, and a means to weigh it down in high winds.

OBJECTS AND ADVANTAGES

The numerous objects and advantages of my invention are:

a.) A boat shelter with base legs that bend in multiple points, both upwards and downwards, which can conform to the terrain of the earth. If the ground wasn't flat, the shelter would be able to sit on top of hills, grooves, ruts, and other parts of uneven terrain without rocking, or rocking that is significantly absorbed.

b.) Both ends of the shelter can be opened or closed as an entrance or exit, or both or whatever combination the customer desires. Moreover, entrances and exits or openings and closings can be formed out of only one piece of a covering by using unique folds.

c.) Both ends of the shelter are completely clear of support pipes or wires so that a vehicle isn't limited to only using one end of the shelter of an entrance and an exit.

d.) The customer has a choice on how many structural support components he or she wants depending on climate. If there is good weather, less structural support can be purchased because there isn't the threat of high winds.

e.) The boat shelter is stable on it's own. There doesn't have to be anything staked into the ground. That means that the shelter could be on soft soil without stakes that won't hold. Likewise the shelter could be on hard ground or rock that stakes can't dig into.

f.) A vehicle can run in and out smoothly without having to hop cross-pipes with tire.

g.) The shelter uses nylon or a like material for straps that hold the arches stable. The straps won't rust like prior art. Consequently, there wouldn't be the problem of a rusty wire snapping and whipping and possibly injuring somebody or causing damage to a vehicle or boat. Also, the straps are flat with the ground for a smooth ride in and out of the shelter rather than a tire having to hop over cross-pipes. Another benefit is that if a strap runs over a major rut and the tire whips it up, it won't cause damage unlike the metal wires.

h.) Every part of the shelter that is exposed to the boat, vehicle or whatever is stored, is made fairly smooth and not jagged. This prevents accidental damage to the paint on the vehicle if it scrapes or rubs the side of the shelter. For example, opening a car door against a jagged metal bracket could scrape the paint.

i.) The shelter contains parts that can simply be unscrewed or taken apart by other easy means. This makes it simple for the customer to pack up and move to a new location.

j.) The manufacturing of the preferred embodiment of the boat shelter would be easier because most the components can already be found on the market.

k.) If a part on the shelter breaks, it can be purchased most likely in a local market rather than having to order specialized parts. This would save the customer time waiting on a delivery. Moreover, most the components are fairly inexpensive. Additional money could be saved on shipping and handling if a customer needed to replace a part.

l.) If a customer desired, he or she could purchase more than one instant boat garage and attach them together side by side. He could then have a two, three, or even four plus car or boat garage.

m.) The shelter is comprised a plurality of segments and so it can be added onto or subtracted from at any time to a customized size. The width can be broadened or made narrower by using longer or shorter straps that connect the two base legs.

n.) The shape of the shelter can be reconfigured from the preferred embodiment into a variety of other shapes such as a dome.

o.) Weigh down devices could be attached for high winds.

Further objects and advantages are that the shorter the segments comprising the base are made, the more the shelter would conform to rougher terrain because there would be more points on the legs that are hinged. If shorter segments of legs were used, more straps, that span the width of the arches and run along the ground, would also have to be used to connect one leg to the other at the extra segments.

There are numerous other benefits related to the usefulness of the instant boat garage. Following are some examples of additional benefits:

1.) If the customer wants to close off an end, he can take the excess tarp that drops over and fold it inward. The tarp can be tied down to hold the folds in place.

2.) If the customer wanted the end to be open, the excess tarp that droops over each end could be folded back on whatever end the opening is desired. Since the tarp is rectangular, it can be folded back over the shelter and contour to the form of the shelter. To prevent the wind from blowing the tarp around, each side can be tied off.

3.) In the preferred embodiment, the base legs are made out of trex or a hard non-rotting materiel. Trex is meshed plastic and wood. Since the base is exposed to earth mostly, it is necessary to use this type of materiel because trex does not rot like regular wood. Another durable quality about trex is that termites can't eat into it. Moreover, it can be drilled into like regular wood. Also it would lie flat to the ground and give the shelter more stability.

4.) The tarp covers the entire boat or vehicle all around the shelter. So no matter which way the wind blows, the vehicle inside the shelter will receive the full benefits of protection.

Still more objects and advantages of my invention will be seen by looking at the drawings and description.

DRAWING FIGURES

In the drawings, closely related figures have the same number but different alphabetic suffixes. Also, the figures progressively add new components to illustrate the steps of assembly.

REFERENCE NUMERALS IN DRAWINGS

Figure 1:
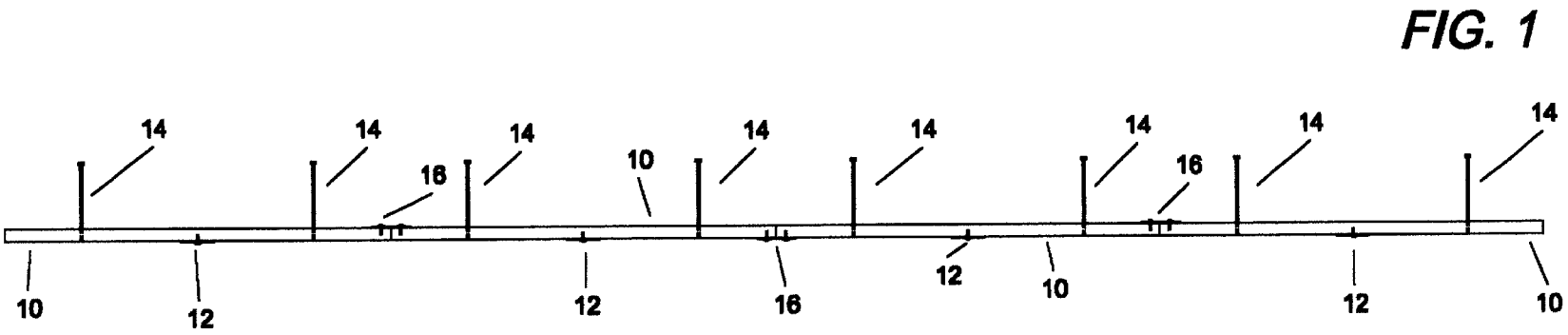
FIG. 1 shows a side view of one of the legs that makes up the base which sits on the ground as a foundation for the rest of the shelter.

10 segment of base leg
12 leg to leg connector
14 long bolt
16 bendy hinge
18 short bolt
20 washer
22 short connecting strap
24 covering
26 long connecting strap
28 post assembly arch pipe
30 post assembly straight pipe
32 end cap
34 loop screw
36 criss cross connector
38 coupling
40 pipe segment
42 rivet
44 dual shelter attachment
46 tarp tie down rope
48 cross coupling
50 circular tarp with slit
52 slit
54 stabilizer rope

DESCRIPTION

FIG. 1 is a side view of one of the two base legs of the shelter that run parallel along the ground in the preferred embodiment. The two base legs aren't labeled as a whole unit but by segments of base leg 10 since the base legs are actually divided into a plurality of segments. Also, this view is without certain components so the shelter can be seen layer by layer in following FIGS. Long bolts 14 can be seen drilled perpendicular to the legs that make up the base. Every segment of base leg 10 has a long bolt 14 drilled in it. A bendy hinge 16 is a strong bendable materiel, preferably nylon, that holds each segment of base leg 10 together to form the entire base leg. A leg to leg connector 12 is a short bolt 18 and a washer 20 that holds a long connecting strap 26 to the leg. Segment of base leg 10 is made out of a hard solid materiel that can be drilled into and won't rot. The preferred materiel is Trex which is meshed plastic and wood.

Figure 1A:
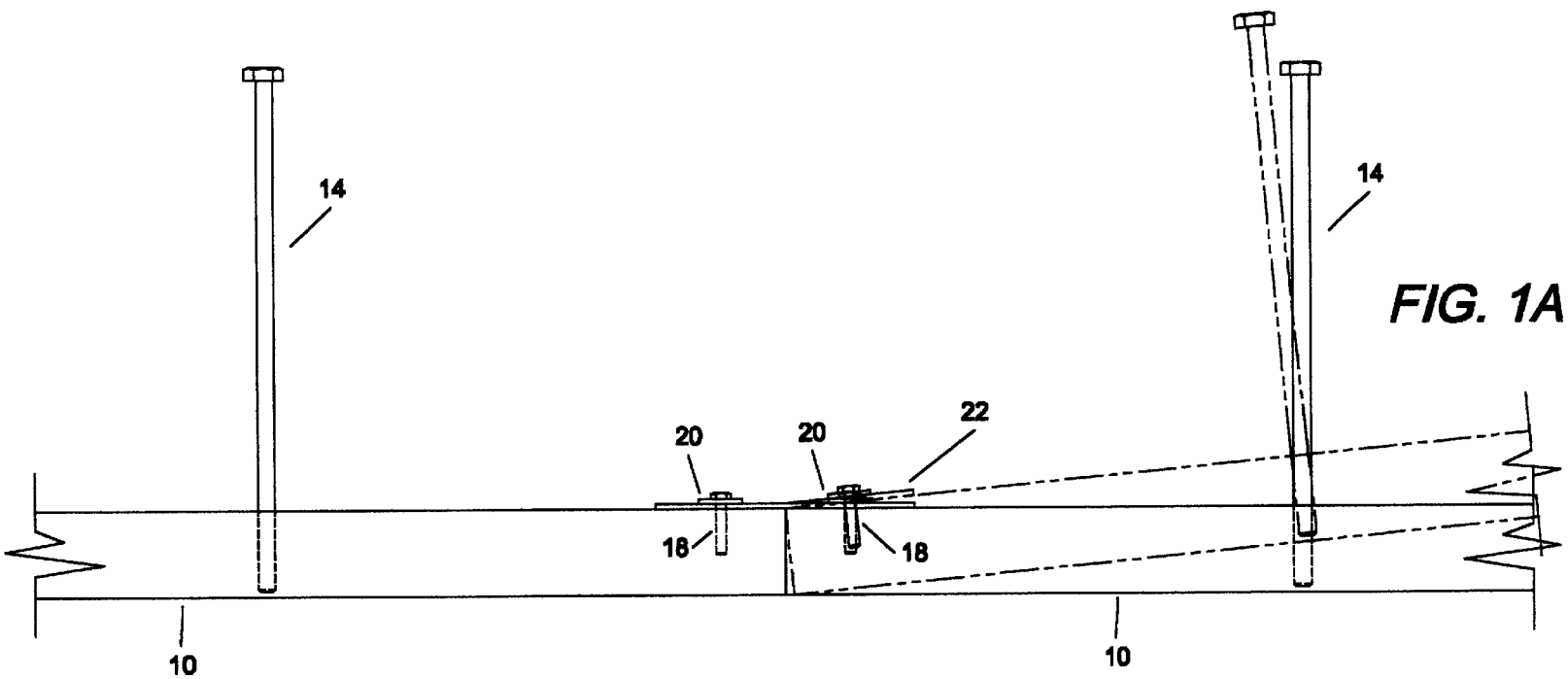
FIG. 1A is a close up section of FIG. 1 at one of the many bendable points.

FIG. 1A is a detailed view of a portion of the above base leg. Short bolt 18 and washer 20 are used on each side of a short connecting strap 22. The entire component can be seen in FIG. 1 as a bendy hinge 16. FIG. 1A also shows how a short connecting strap 22 is bendable by the right side of the two segments of base leg 10 being raised. The two long bolts 14 are close ups of long bolts 14 in FIG. 1.

The exact placement of long bolts 14 is variable because the customer could have a choice of how many arches he wants. Since the arches are held together by long bolts 14, the amount of arches used, would determine how many long bolts 14 that are needed. If there was a very erratic climate where the customer lived, more arches could be used for extra support. Moreover, since the size, length and width of segments of base leg 10 can also change relative to the terrain, i.e. shorter segments of base leg 10 provides more bendable points that can conform closer to more radical terrain, the exact measurements for the placement of long bolt 14 is infinitely variable. Moreover, lengths of long bolts 14 are also infinitely variable in theory since so many different lengths would work. The same argument can be applied to all the other components of the instant boat garage because one of the features of the instant boat garage is that it could be custom ordered in size, length, width, height, strength, and etc. However, if more dimensions are used than others, it does not limit the protection of the patents full legal scope which would legally protect all variable shapes and sizes of this invention.

Figure 2:
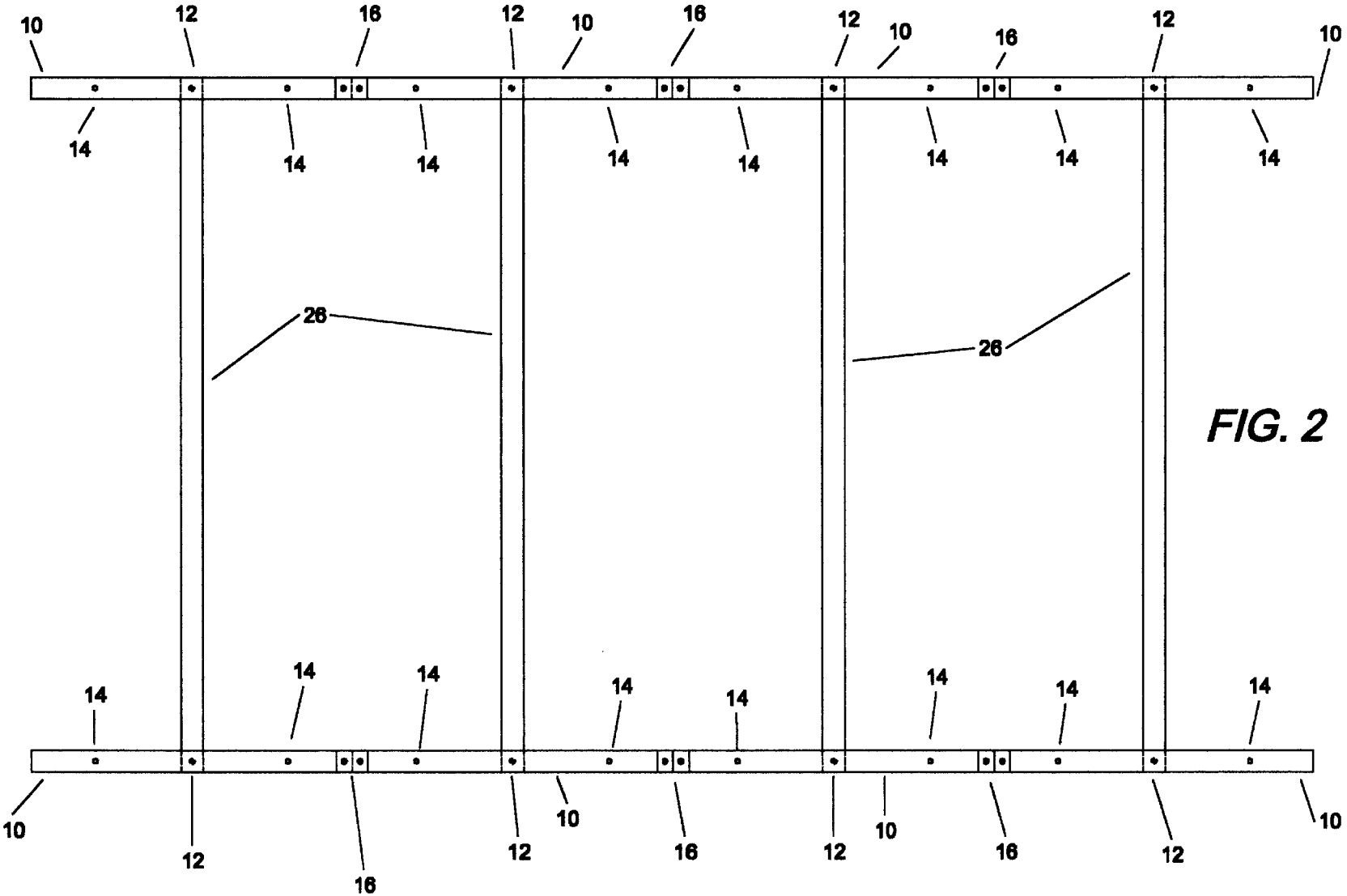
FIG. 2 is a top view of the two base legs that are attached in various places so they run parallel.

FIG. 2 is a top view of the shelter at a beginning step of construction. The entire FIG. 2 is seen as a top view of FIG. 1 with the addition of the other adjoining leg that makes up the base. Since long bolts 14 are seen from the top, they appear to be dots. Bendy hinges 16 and leg to leg connectors 12 similarly have dots that are a short bolt 18 and a washer 20. Each segment of base leg 10 is defined by the line in the middle of each bendy hinge 16. A long connecting strap 26 connects the two base legs together at the same length. This leaves both base legs running parallel to each other.

Figure 3:
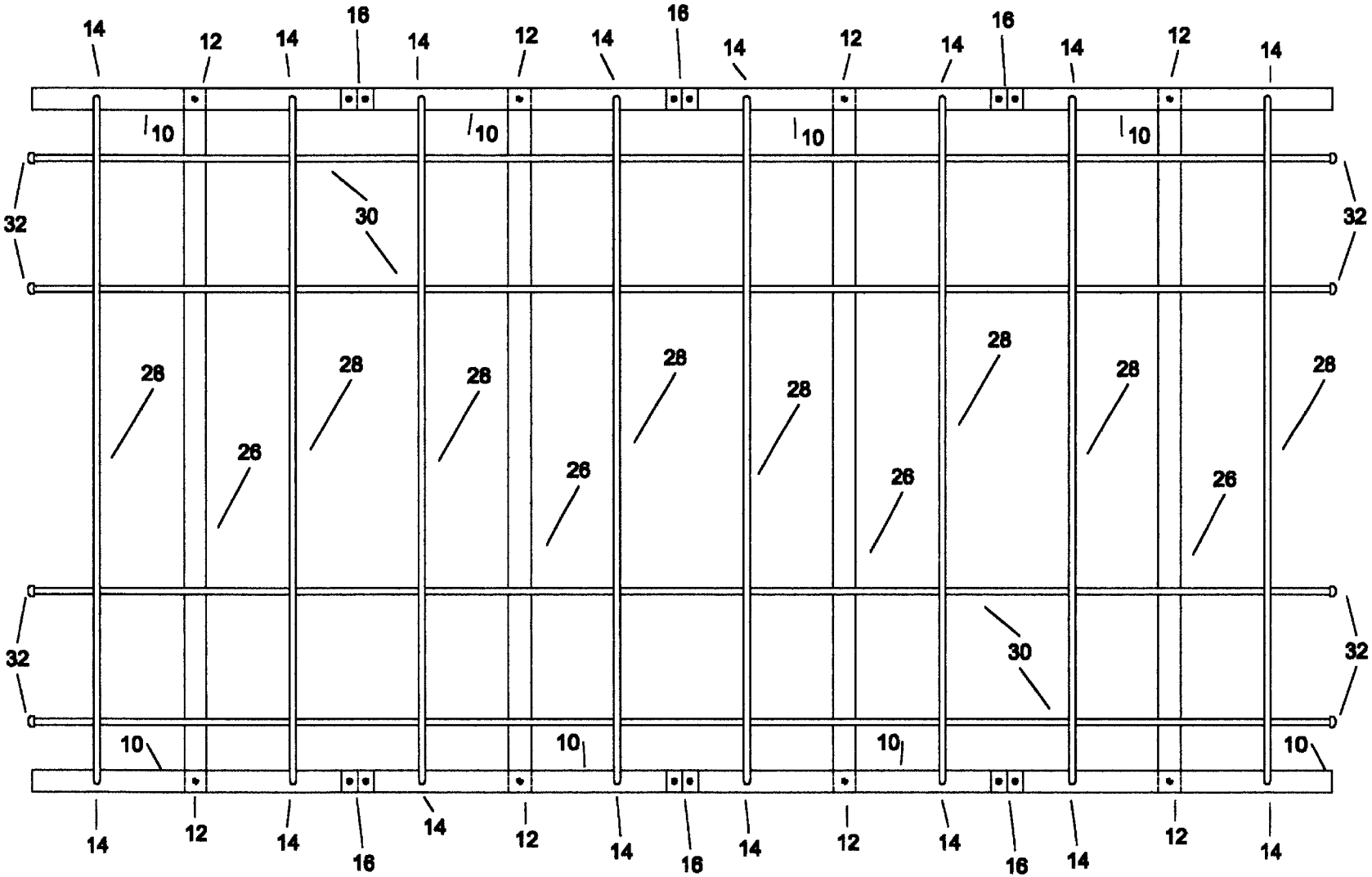
FIG. 3 shows the same as FIG. 2 with the addition of the skeletal frame.

FIG. 3 is the same view as FIG. 2 with the addition of some more components. Long bolts 14 in FIG. 3 can no longer be seen because in this illustration, they are covered by post assembly arch pipes 28. A post assembly arch pipe 28 is slid on top of a long bolt 14. It is then bent over to the opposite long bolt 14 on the other leg that makes up the base and attached there. This forms an arch in a post assembly arch pipe 28. The arch is held by each long bolt 14 it is slid on at each of the ends of the post assembly arch pipe 28. A post assembly straight pipe 30 runs the length of the shelter in various points along the post assembly arch pipes 28. A post assembly straight pipe 30 is attached at each intersecting point along the post assembly arch pipes 28. Each post assembly arch pipe 28 and post assembly straight pipe 30 are made from pipe that is bendable such as pvc pipe. An end cap 32 is just wider than a post assembly straight pipe 30. An end cap 32 is placed on the end of each post assembly straight pipe 30.

Figure 4:
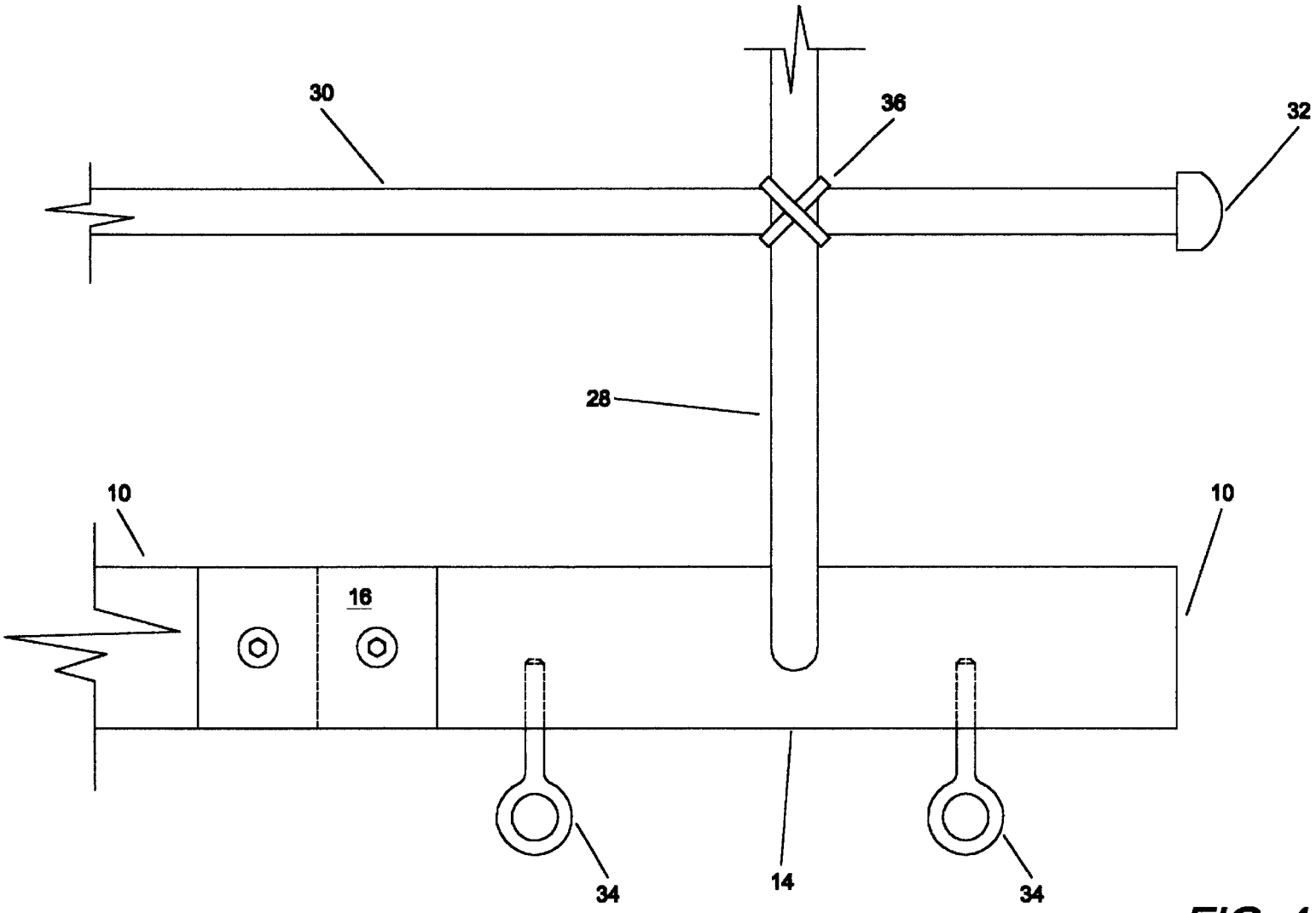
FIG. 4 is a detailed top view of one of the comer sections of FIG. 3 with some components added.

FIG. 4 is a top view of one corner of the shelter. A loop screw 34 is screwed into each segment of base leg 10 horizontal to flat earth. A loop screw 34 is also perpendicular to the outer edge side of a base leg 10. A long bolt 14 is hidden under a post assembly arch pipe 28. A criss cross connector 36 is a device that attaches a post assembly straight pipe 30 and a post assembly arch pipe 28 at each intersecting point. A criss cross connector 36 in the preferred embodiment is made from zip ties or a stronger materiel such as adjustable belt straps if the customer wants to invest more or rope would be a lower investment. An end cap 32 is attached to the end of post assembly straight pipe 30 in FIG. 4. A top view of a bendy hinge 16 can also be seen in FIG. 4 holding together two segments of base leg 10.

Figures 5, 5A:
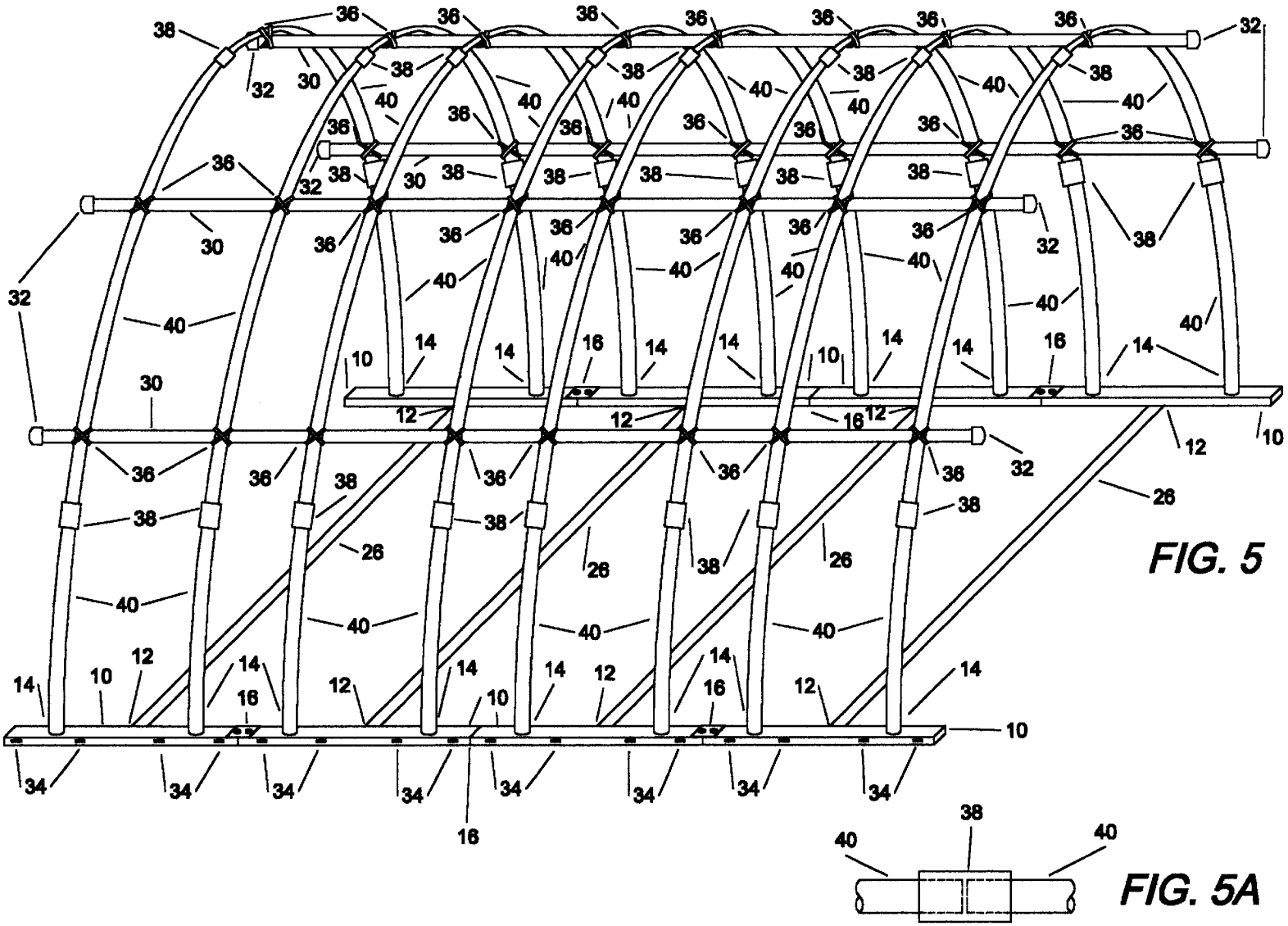
FIG. 5 is a diagonal view of the skeletal frame with all its components that would normally be visible.

FIG. 5 is a diagonal side view of FIG. 4 with a coupling 38 added. A coupling 38 is found along various points of a post assembly arch pipe 28. In FIG. 5, several arch pipe segments 40 are connected together by several couplings 38 to make one long pipe. A post assembly straight pipe 30 is also connected together by several couplings 38. In FIG. 5, couplings 38 can't be seen on post assembly straight pipes 30. It is shown this way without couplings 38 to illustrate that a post assembly straight pipe 30 and a post assembly arch pipe 28 can be just one solid pipe or a series of arch pipe segments 40, depending on customer need. An end cap 32 can be seen in FIG. 5 at the end of each post assembly straight pipe 30. Also, criss cross connectors 36 can be seen at each intersecting point of a post assembly straight pipe 30 and a post assembly arch pipe 28. A post assembly arch pipe 28 isn't labeled in FIG. 5 because it is shown by its separate components.

Also in FIG. 5, all segments of base leg 10 are attached together by a bendy hinge 16. However, segments of base leg 10 in the middle of each base leg are connected by a bendy hinge 16 on the underside instead of the top of segments of base leg 10. A loop screw 34 can be seen in FIG. 5 along various points on the closest leg that makes up the base. The farthest base leg also has loop screws 34 but they are hidden in this illustration. Long bolts 14 are numbered on points along each segment of base leg 10 in FIG. 5. However segments of arch pipe 40 cover each long bolt 14. Every leg to leg connector 12 connects the end of each long connecting strap 26 from one point on a base leg to it's mirror point on the other base leg.

FIG. 5A is a close up of two segments of arch pipe 40 connected by a coupling 38.

Figure 6:
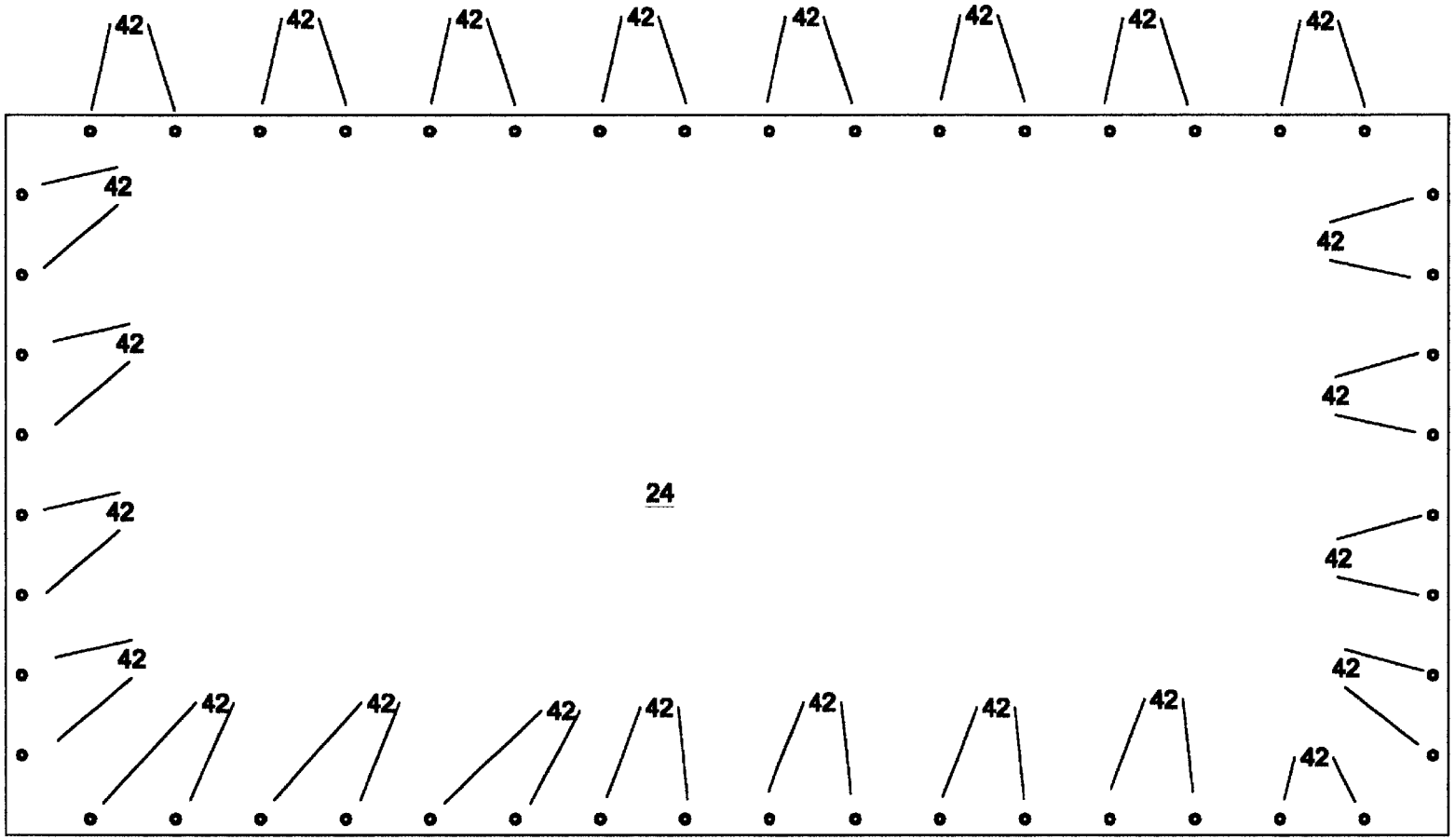
FIG. 6 is a top view of the covering that lies over the skeletal frame.

FIG. 6 is a top view of a covering 24 that goes over the skeleton of the shelter. Rivets 42 are found along the edge of covering 24 on various points.

Figure 6A:
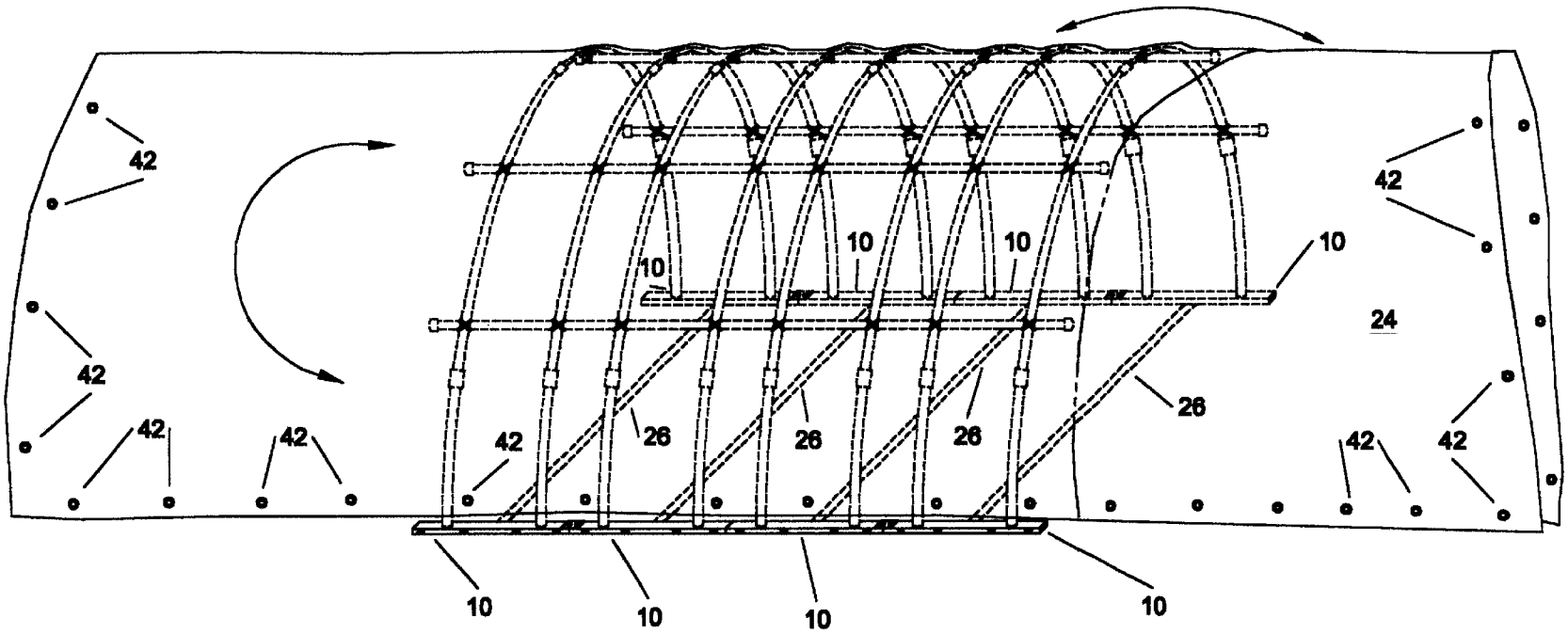
FIG. 6A is the covering after it is laid over the skeletal frame. The arrows show different ways of folding the covering.

FIG. 6A is covering 24 placed over the skeleton of the shelter. The components labeled by their appropriate numerals segments of base leg 10, and long connecting straps 26 are given to show that the skeleton in FIG. 6A is the same skeleton in FIG. 5. The other numerals aren't on here to keep the illustration clear. A rope would also clutter the illustration but it will connect rivets 42 to loop screws 34 seen in FIG. 5. Covering 24 is laid on top the skeleton evenly. The entire skeleton is sheltered by the width of covering 24. The length of covering 24 is longer than the length of the shelter. The arrows show how to fold covering 24 back or inward to form open or closed ends of the shelter.

Figure 7:
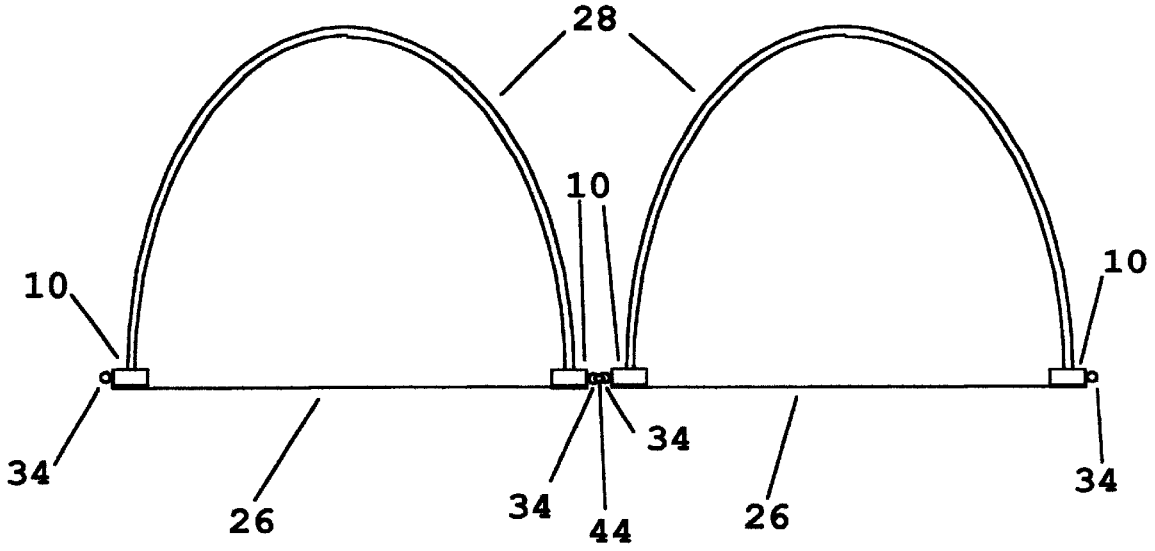
FIG. 7 illustrates a front view of two or more instant boat garages attached side by side.

FIG. 7 is a front view of two instant boat garage preferred embodiments linked together side by side. The front ends of segments of base leg 10 can be seen here. Post assembly arch pipes 28, long connecting straps 26, and loop screws 34, can be seen here as described in prior FIGS. A dual shelter attachment 44 is the focus of FIG. 7. Dual shelter attachment 44 is a simple device to hold two loop screws 34 securely attached. Rope would maintain such a secure attachment.

Figure 7A:
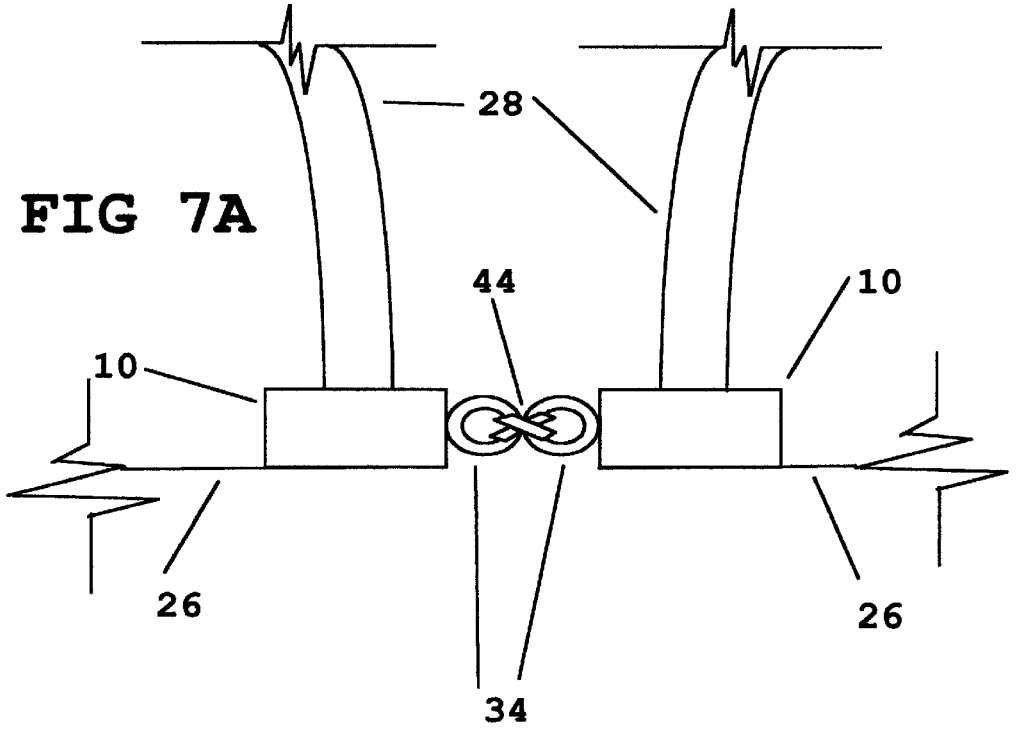
FIG. 7A shows a close up frontal view of the section of FIG. 7 where the two instant boat garages are adjoined.

FIG. 7A is a sectional view of FIG. 7 where the two shelters of the preferred embodiment are linked side by side. Segments of base leg 10, and long connecting straps 26, are of the same description from earlier FIGS. Loop screws 34 in FIG. 7A are held together by dual shelter attachment 44 as described in FIG. 7.

Figure 8:
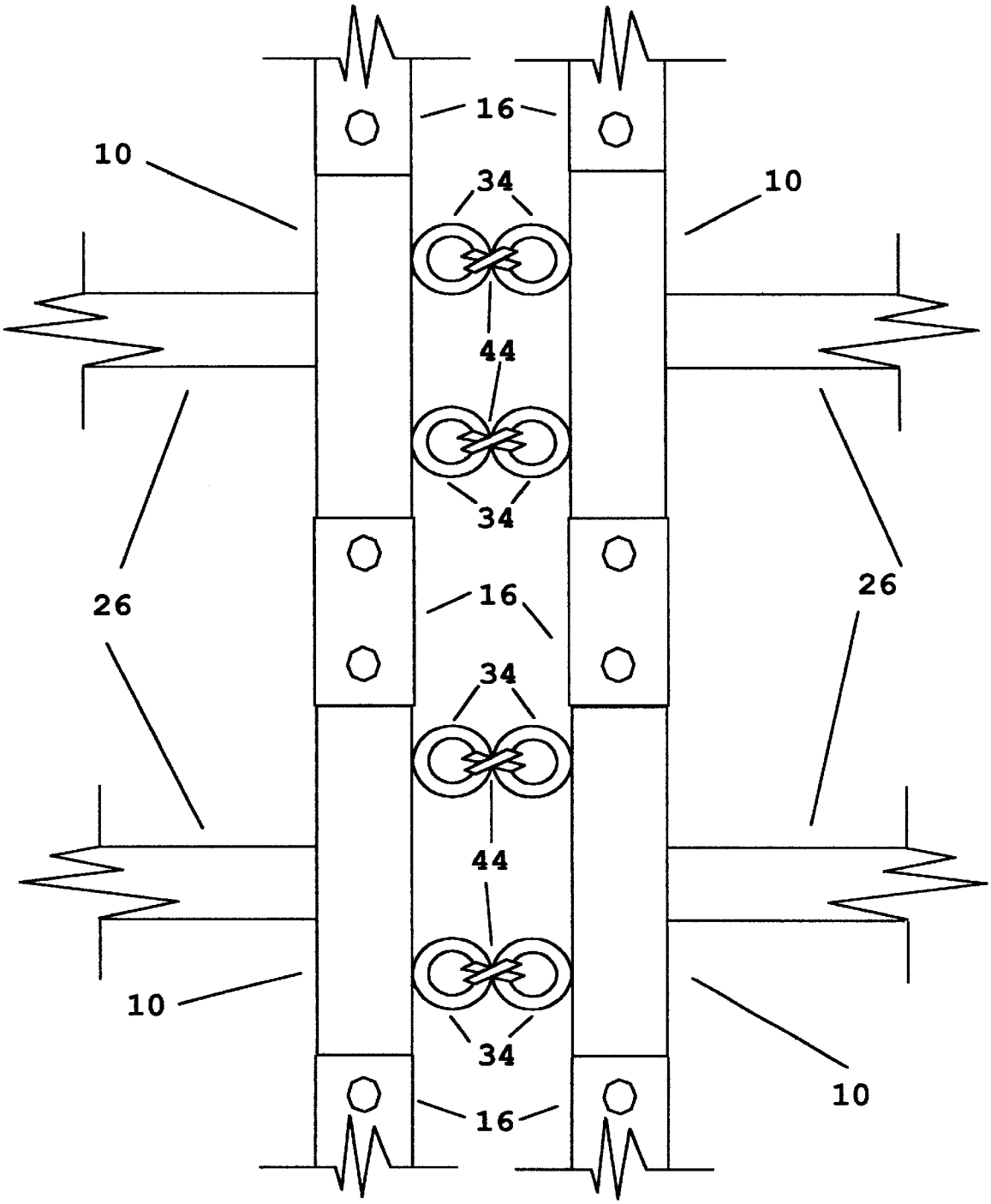
FIG. 8 is a detailed top view of a section of FIG. 7 showing a plurality of attachments of the juxtaposing instant boat garages.

FIG. 8 is a top sectional view of FIG. 7 where the two shelters meet and connect. Long bolts 14, post assembly arch pipes 28, and covering 24 aren't seen in FIG. 8 so as to emphasize where the shelters are connected. However, segments of base leg 10, long connecting straps 26, and bendy hinges 16, are illustrated so the reader can follow. Loop screws 34 from one shelter are seen connected to loop screws 34 from another shelter in FIG. 8. Dual shelter attachments 44 are the same as described in FIG. 7 and FIG. 7A.

Figure 9:
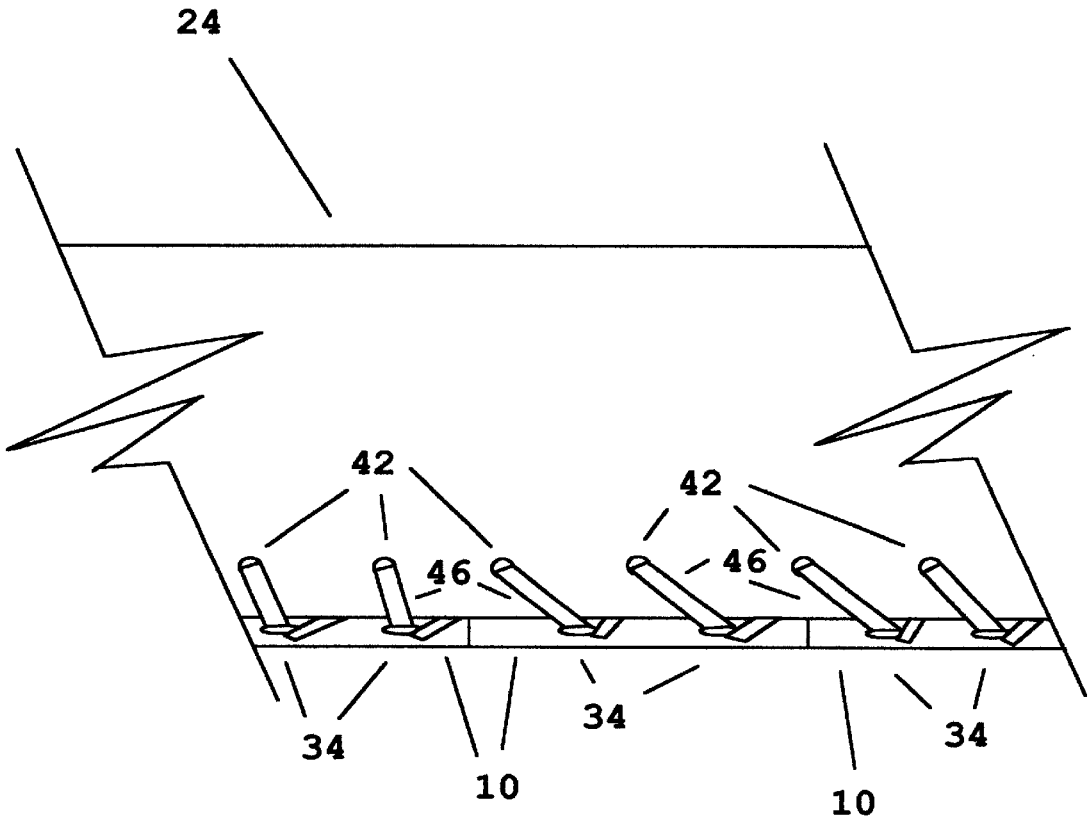
FIG. 9 is a sectional side view of an instant boat garage illustrating how a tarp can be anchored to the base.

FIG. 9 shows a section of the side of the preferred embodiment of the instant boat garage. FIG. 9 illustrates covering 24 attached by tarp tie down rope 46 which is threaded through rivets 42 to loop screws 34 on segments of base leg 10.

Figure 10:
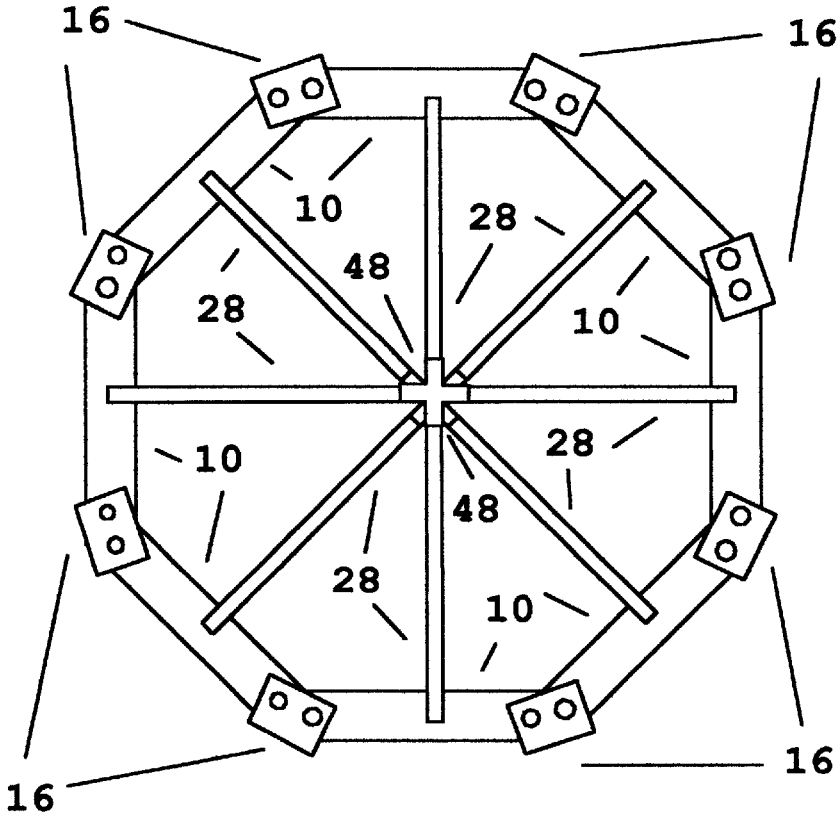
FIG. 10 illustrates a top view of the skeleton of a dome that the instant boat garage can be transformed into.

FIG. 10 is a top view of the skeleton of a dome transformed from the preferred embodiment of the instant boat garage. FIG. 10 illustrates the same parts used in the preferred embodiment with the exception of a cross coupling 48. Cross coupling 48 is virtually the same as coupling 38. The difference is that coupling 38 has two ends and cross coupling 48 has four ends that post assembly arch pipe 28 as shown in FIG. 10, post assembly straight pipe 30 or pipe segment 40 as seen in earlier FIGS, can be plugged into. FIG. 10 contains post assembly arch pipes 28 that are placed over the hidden long bolts 14 as they are illustrated in the preferred embodiment. Post assembly arch pipes 28 are connected in the middle of each segment of base leg 10 and bent to the mirror side of an octagon. Bendy hinges 16 connect segments of base leg 10 together as in the preferred embodiment but they hold a 45 degree angle in the dome.

Figure 10A:
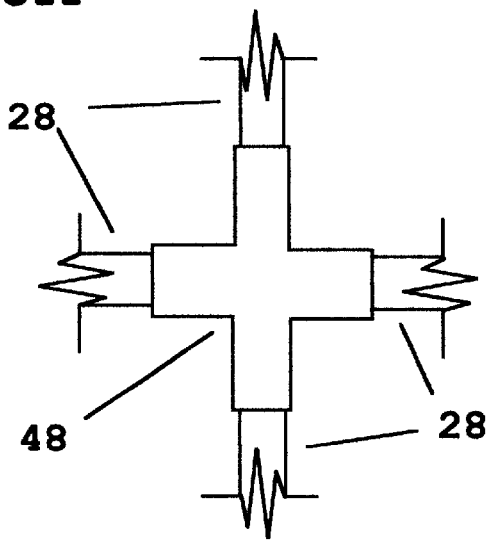
FIG. 10A is a sectional view of FIG. 10 that shows a close up of a component that holds four pipes at once at the same level.

FIG. 10A is a detailed sectional view of a part of the middle of FIG. 10. Cross coupling 48 is shown here blown up. FIG. 10A is to illustrate that FIG. 10 actually has two cross couplings 48 with one on top the other. At a glance it could appear that there is an eight ended coupling in FIG. 10 rather than a cross coupling 48 with four ends on one level and another cross coupling 48 on top of it. Post assembly arch pipes 28 are seen in FIG. 10A as being attached to the ends of cross coupling 48.

Figure 10B:
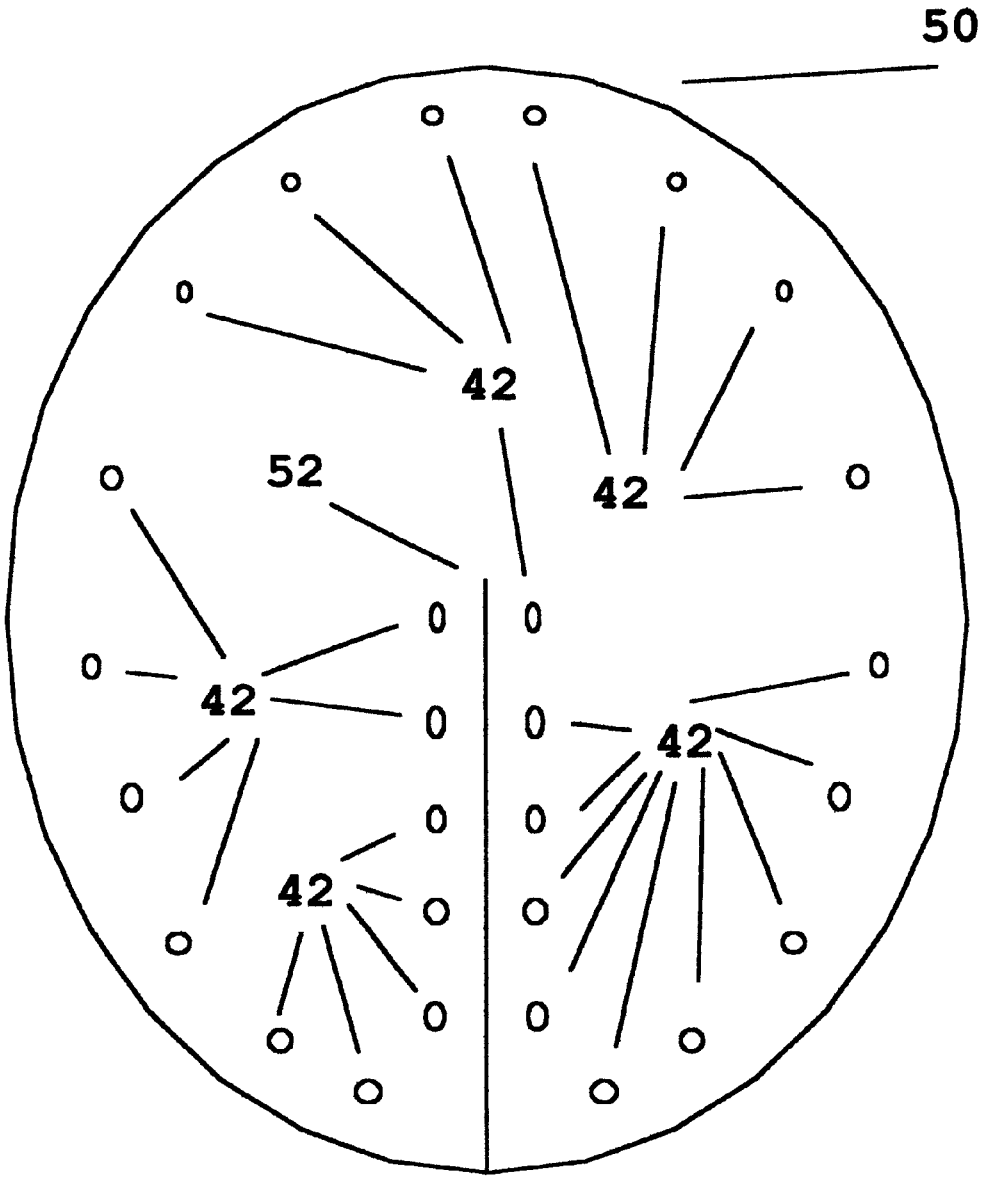
FIG. 10B illustrates a form fit circular tarp with a slit for an opening to cover a dome as in FIG. 10, or a half dome as in FIG. 14.

FIG. 10B is what can go over the domes skeleton, from FIG. 10, in the form of a tarp that will provide covering for what's being stored inside the dome. A circular tarp with slit 50 is similar to covering 24. The difference is that it is shaped in a circle instead of a rectangle. Also circular tarp with slit 50 has a slit 52 that is a cut in circular tarp with slit 50 that is a straight line from an outer edge to the midpoint of the circle. Rivets 42 can be found around the inside perimeter of circular tarp with slit 50 as well as on either side of slit 52.

Figure 10C:
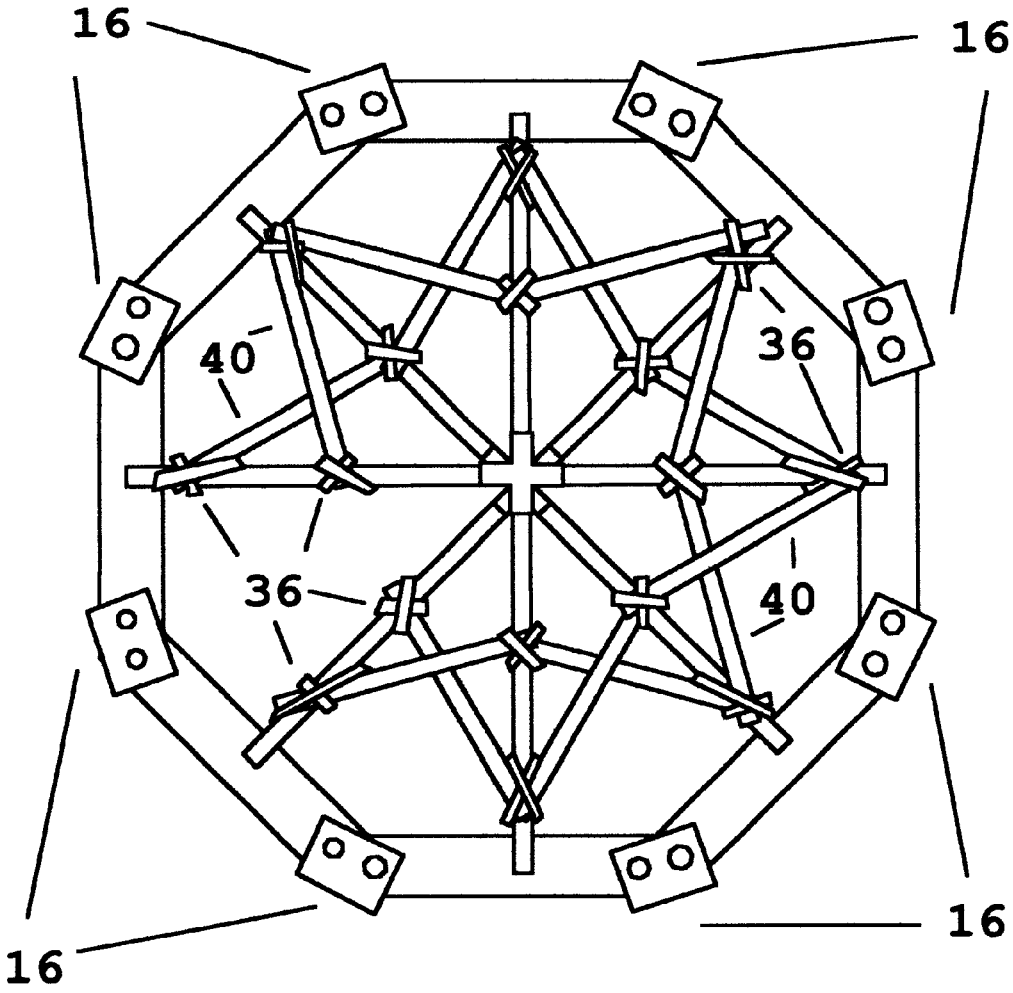
FIG. 10C is a top view of FIG. 10 with the addition of pipes that fill the spaces where the tarp would otherwise droop inside the dome.

FIG. 10C is the same as FIG. 10. Bendy hinge 16 is shown the same as in FIG. 10 however the other parts aren't labeled because the emphasis is on the added pipe segments 40. Pipe segments 40 form crosses and fill each gap between the arches. Criss cross connector 36 can also be seen in FIG. 10C as being attached at each end point of the newly added pipe segments 40.

Figure 11:
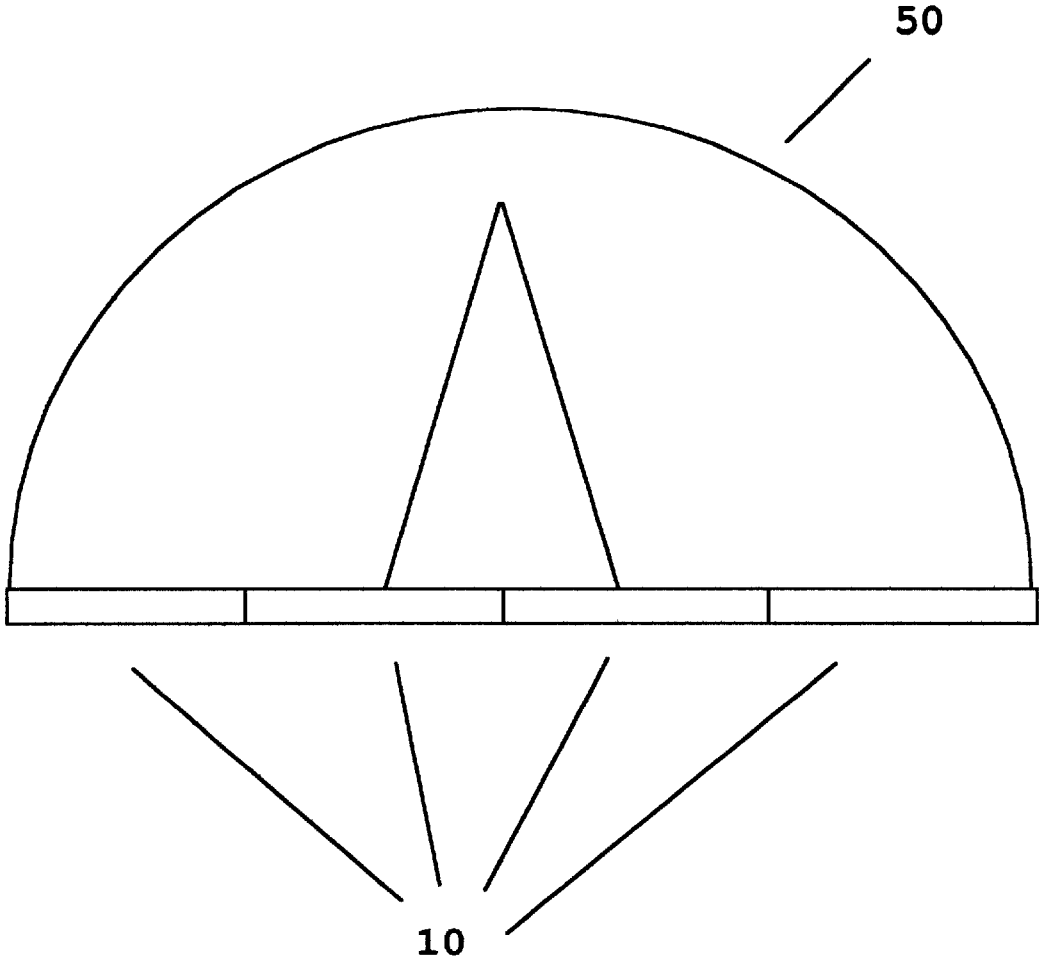
FIG. 11 illustrates a front view of FIG. 10 with the tarp in FIG. 10B added with the slit open.

FIG. 11 is a front view of a dome made like the preferred embodiment of the instant boat garage with a different shape. Circular tarp with slit 50 can be seen in FIG. 11 as attached to the dome frame. Slit 52 isn't labeled but can be seen as opened in the form of a triangle and can be referred to in FIG. 10B. As mentioned prior, loop screws 34, and other components aren't seen because it is given that the dome is made like the preferred embodiment. Segments of base leg 10 are only labeled to show the bottom as the base.

Figure 12:
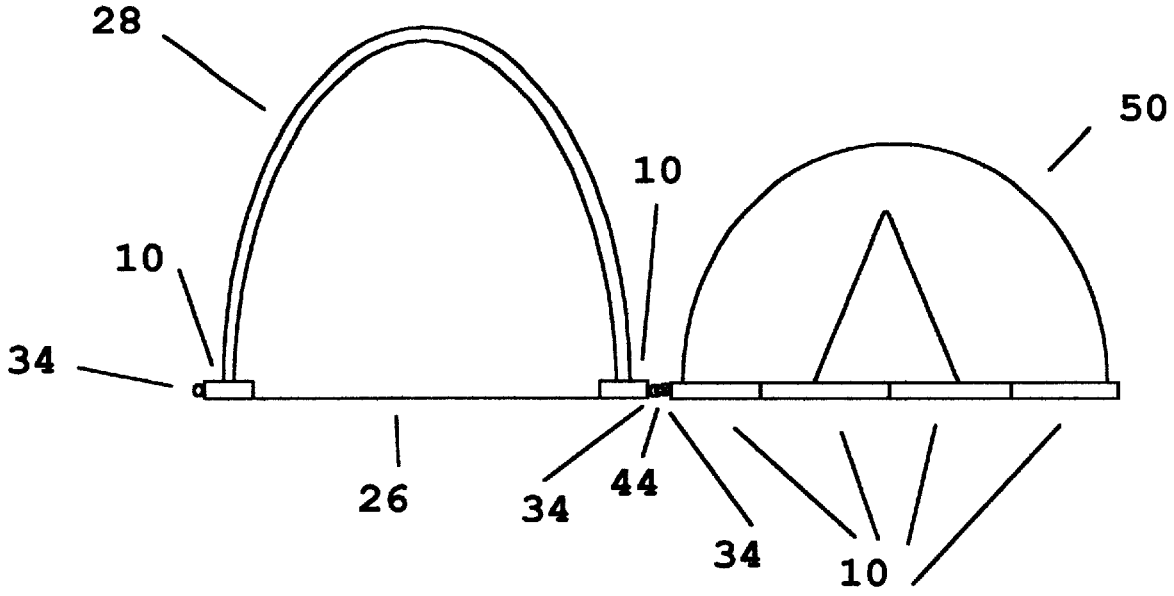
FIG. 12 illustrates a front view of the preferred embodiment and a dome adjoined side by side.

FIG. 12 is an illustration of the preferred embodiment of the instant boat garage attached side by side with the dome shape of the instant boat garage. The preferred embodiment is labeled with some of it's main components of post assembly arch pipe 28, segments of base leg 10, and long connecting strap 26. However, these components are to show the basic relation of the components and the emphasis should be where the dome is connected to the preferred embodiment. The components that should be emphasized are loop screws 34 and dual shelter attachment 44. Dual shelter attachment is the same basic instrument that holds loop screws 34 together in FIG. 7. The other component seen here is circular tarp with slit 50 that is also illustrated to show a general relation of the components and doesn't have much emphasis in FIG. 12.

Figure 13:
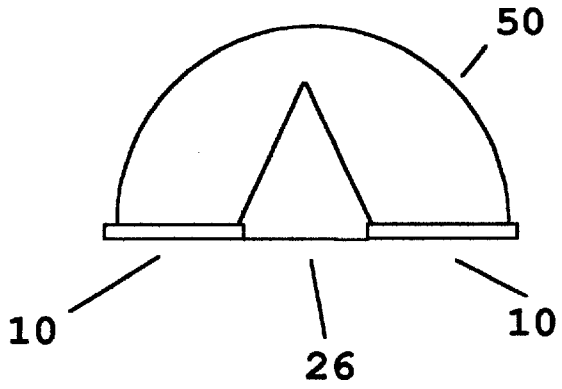
FIG. 13 illustrates a front view of a dome that uses a strap rather than a section of base leg to connect under the opening.

FIG. 13 is the same dome in FIG. 12 but without any obstacle under the opening. The same components such as circular tarp with slit 50 and segments of base leg 10 are used like in FIG. 10, FIG. 10B, and FIG. 11. However, in FIG. 13, long connecting strap 26 is used in place of one of the segments of base leg 10 and the opening is placed over it.

Figure 14:
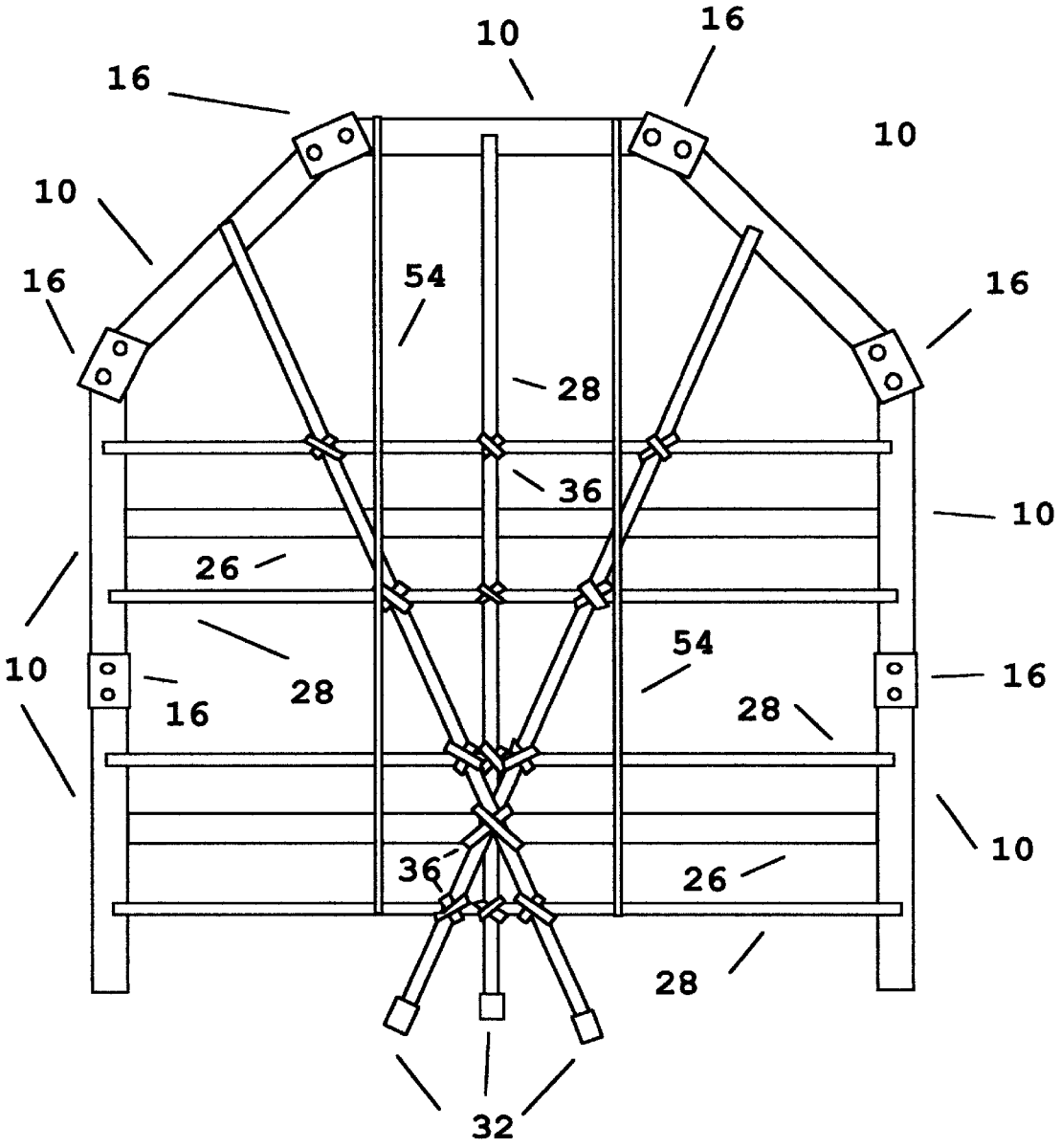
FIG. 14 illustrates the top view of a skeleton of an extended half dome.

FIG. 14 is a top view of the skeletal frame of an extended half dome constructed from the same components as the preferred embodiment of the instant boat garage. Segments of base leg 10 are positioned to form a partial octagon, at the base, which are held together by bendy hinges 16. The open end of the partial octagon is held in place by long connecting strap 26. There is also a long connecting strap 26 that goes across the middle of the extended half dome. Post assembly arch pipes 28 form arches across the width of the partial octagon and are held in place by long bolts 14, not illustrated here, used in the same fashion as the preferred embodiment of the instant boat garage. There is are additional post assembly arch pipes 28 that run across the other post assembly arch pipes 28 which are held on to the other post assembly arch pipes 28 by criss cross connectors 36. The end of post assembly arch pipes 28 that start at the open end of the partial octagon have end caps 32 as in the preferred embodiment. The reason post assembly arch pipe 28 is used with end cap 32 instead of post assembly straight pipe 30, as in FIG. 5 of the preferred embodiment, is to prevent confusion, although both pipes bend and are the same pipes only with different positioning in FIG. 5. The other end of these post assembly arch pipes 28 are bent down and held onto the middle of segment of base legs 10 at the closed end of the skeleton in the same fashion as the preferred embodiment. A stabilizer rope 54 runs on both sides of post assembly arch pipe 28 that forms the arch on the open end of the shelter to segment of base leg 10 at the butt end of the shelter.

Figure 14A:
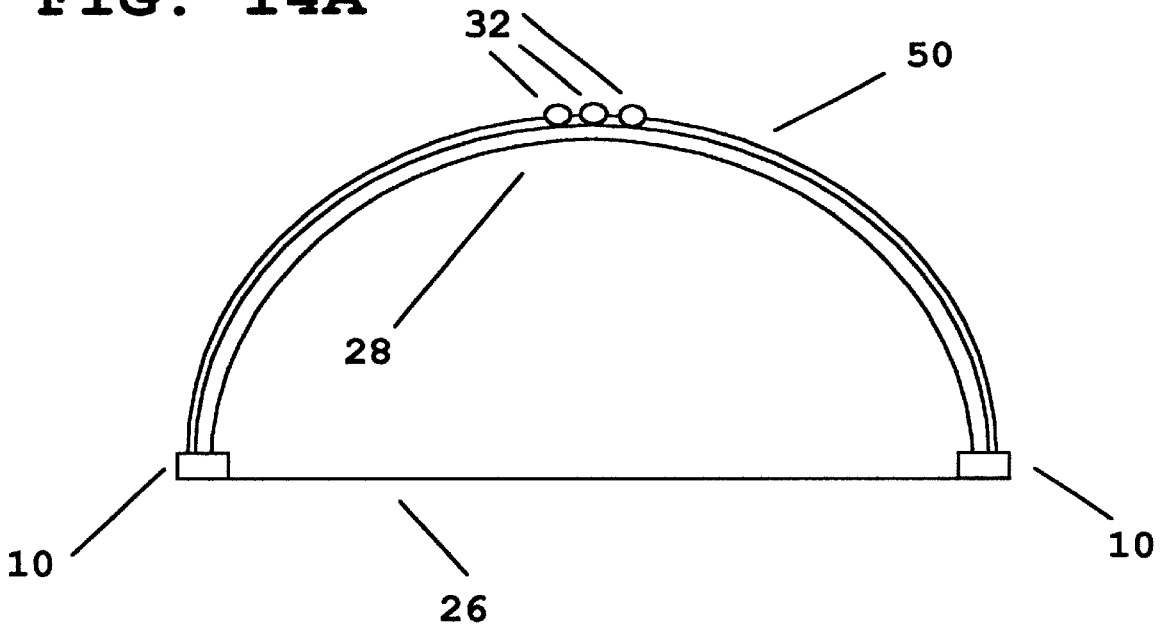
FIG. 14A shows a front view of FIG. 14 with the addition of the tarp folded in half from FIG. 10B.

FIG. 14A is the front view of the extended half dome in FIG. 14. Only post assembly arch pipe 28 that forms the front arch can be seen in FIG. 14A. The other post assembly arch pipes aren't seen as they are already illustrated in FIG. 14 and the emphasis of FIG. 14A is on the open end of the half dome. End cap 32 is shown in FIG. 14A at the arches tip of the front post assembly arch pipe 28 and further details can be found in FIG. 14. The ends of the front two segments of base leg 10 can be seen in FIG. 14A holding the front post assembly arch pipe 28 as well as being held together by long connecting strap 26 as in the preferred embodiment.

ADDITIONAL EMBODIMENTS

As my description and operation sections of this patent application have many specifications, they shouldn't be misunderstood as anything that limits the scope of my invention. On the contrary, they should be seen as exemplifying my preferred embodiment thereof My invention has many variations that exist. For example, if there are high winds, a customer could use sand bags or some other form of a weigh-down device, such as water jugs, that will keep the "instant boat garage" from blowing around. These weigh-down devices can be strapped, connected, or tied onto the "instant boat garage" where the customer prefers. If the customer wanted, the weigh-down devices could even be hung on the arches. However a preferred position would most likely be on the base legs. If the ground permits, stakes could even be driven into the ground that holds the shelter in place by an attachment of rope, wire or something similar.

Another example of a variation is that if a customer preferred to purchase more than one "instant boat garage," connector devices other than dual shelter attachment 44 could be used to attach the garages side by side. Even a metal clip, strong zip ties, wire, or the like could be used to connect more than one "instant boat garage" in juxtaposing position.

Some additional examples are:

Bendy hinge 16 can also be made from any materiel similar to nylon that has the same strong hold and bends. Although the FIGS illustrate two bendy hinges 16 on top each base leg and one on the bottom, bendy hinge 16 could be connected in any combination of top and bottom. Bendy hinge 16 could also be connected all along the top or all along the bottom of the base legs. The side it's connected to determines what way the two segments of base leg 10, it holds together, will bend. If bendy hinge 16 is placed on the bottom of a base leg, the two segments of base legs it hinges will bend over a hill, as previously mentioned. Conversely, if bendy hinge 16 were placed on top the base leg, the two segments of base leg 10 bendy hinge 16 connects, will fit into a groove in the ground, as previously mentioned.

Segments of base leg 10 could be made out of any materiel that is hard enough to sustain the same hold from the tension of the arches. Even specially treated wood could work. Segments of base leg 10 could also be made shorter, longer, narrower, or wider. Also, the overall shape can be made different so long as they serve the previously mentioned purpose. The shorter segments of base leg 10 are, the more bendy hinges 16 are that can be added. Shorter segments of base leg 10 would allow for the base legs to conform more to the terrain, as they would provide more bendable places on the base legs. Longer segments of base leg 10 would be used more for flat land and could save money on bendy hinges 16 if they aren't needed. Any amount of segments of base leg 10 and bendy hinges 16 could also be used. Thus the length of an "instant boat garage" can be customized. The length of the base legs can be determined by how many segments of base legs 10 that are used in relation to the custom size of each segment of base leg 10. The size and how many segments of base leg 10 used as well as how many bendy hinges 16 are needed could be changed to form fit over most terrain.

There is no limit on how many long bolts 14 that can be drilled into the base legs. As many long bolts 14 as possible could be used depending on how strong the customer wants his shelter, as more long bolts 14 would hold more post assembly arch pipes 28. The strength of the shelter that is needed can be determined by climate.

Also, long bolt 14 doesn't have to be in every segment of base leg in order for the invention to work properly.

Moreover, any long cylindrical narrow device such as a screw, rod, or pin could be used for long bolt 14. It doesn't even have to be cylindrical so long as it can be inserted into post assembly arch pipe 28 or pipe segment 40. Another thing about the long bolt 14 is that the length and width can be determined in accordance to the chosen pipe size.

Criss cross connector 36 doesn't have to be limited to zip ties. It can be made from anything bendable, like a rope, wire, or twine, that can hold post assembly straight pipe 30 to post assembly arch pipe 28. Adjustable or just plain belt straps could also be used. Another possibility is an adjustable clamp.

Loop screws 34 could be attached on top the base legs as well as on either side. Loop screws 34 could also be hooks or any device that would hold the rope, wire, line, or similar tie-in device that connects covering 24 to the base legs.

Although long connecting straps 26 are the same length in the preferred embodiment, the length can be played with to customize any unique shape frame.

Although the preferred embodiment uses coupling 38, other attachment means can be employed. For example, a wider diameter of pipe segment 40 that slides into another pipe segment 40 with a narrower diameter. Then the two ends could be glued together if an extra hold is preferred. The length, size, width, and shape of coupling 38, post assembly straight pipe 30, post assembly arch pipe 28 or pipe segment 40, is variable. Thus, strength, width, and height of the arches are variable. Likewise, the length, width, and strength of post assembly straight pipes 30 are variable. The number of post assembly straight pipes 30 used can change according to how strong the customer needs the "instant boat garage" to be. This factor could be determined by climate, terrain, or customer need. Likewise, the amount of arches a customer needs is variable.

Other devices could also be used for short bolt 18 such as a screw.

Long connecting strap 26 can be made out of nylon or other strong bendable materials.

Leg to leg connector 12 can also be a screw or any alternative connecting device, so long as it holds each end of long connecting strap 26 secure to the base legs.

Although covering 24 can be plastic or nylon, depending on what the customer wants to invest, any materiel with similar protective means could be used. However, if the customer wanted to use the "instant boat garage" as shading only, a materiel such as netting could be used. Netting could also be used to keep out mosquitoes if the "instant boat garage" were used to sleep in or work in.

Even though covering 24 can be used as an inexpensive way to form closures and openings by simply folding it in a unique way, if the customer wanted to invest more, separate tarps could be designed to form fit the openings or closings. Thus there are many ways covering 24 could be arranged. It could be opened or closed by, flapping it over, using a zipper, Velcro, buttons, snaps, rivets, or the like.

Another thing covering 24 could be used for is on shelters of this patent application other than the preferred embodiment. However, covering 24 works best on the preferred embodiment.

Devices other than tarp tie down rope 46 could be used for the same function. For example, wire, twine, yarn, nylon straps, and the like could also be used.

Components other than cross coupling 48 such as coupling that has more than four outlets could be used. For example, if a coupling with eight outlets were used, it would eliminate having to use two couplings. Instead, only one coupling could be used because it has the same amount of outlets as two. Also, one coupling with eight outlets would create only one level of post assembly arch pipes 28 at the top of the dome rather than piling two layers on top of each other. However, if a coupling with more than four outlets were used, the customer might have to specially order it. On the other hand, if the customer has access to it, there is no reason why they shouldn't invest in it depending on what type of customized shape instant boat garage they are using.

Any size circular tarp with slit 50 could be used depending on what size dome or half dome the customer wants.

Any size slit 50 could be used depending on how big or small the customer wants his or opening. Other shapes of slit 50 could be used as well. For instance, if the consumer preferred a Roman arch, a Roman arch could be cut into circular tarp with slit 50. A square or rectangular doorway could also be specially designed as well as infinite other specialized doorways. Even a zipper, snaps, buttons, or Velcro could be used instead of rivets 52 if so desired.

Any amount of segments of base leg 10 could be used for the dome in FIG. 10. This could create larger or smaller. Consequently, different angles than 45 degrees on the inside of the octagon in FIG. 10 could result. This concept applies to the half dome as well as any other shape the instant boat garage can be made into.

Any combination of instant boat garages can be attached side by side as in FIG. 12 whether they are of the preferred embodiment or other forms.

Any alternative embodiment listed for components of the preferred embodiments also applies to the dome, half dome, and all other shapes that can be made relevant to this patent application or patent granted in the future.

Instead of post assembly straight pipe 30 on the preferred embodiment, metal or other types of rods can be inserted actually through the post assembly arch pipes 28. This can be done by drilling a plurality of holes through post assembly arch pipes 28, parallel to the base legs, and in the same direction and location that post assembly straight pipes 30 normally would go. The rods would hold the arches stable and serve the same purpose as post assembly straight pipe 30. A pin or other type of component that prevents the rods from slipping out could be used in place of end cap 32. Also, the rods could be a series of smaller components held together by couplings for rods rather than one long rod.

An actual hinge similar to the kind of hinge on a door could be used in place of bendy hinge 16.

Multiple holes can be drilled in segments of base leg 10 so the consumer can play with the components and find where he or she wants to connect them to the base leg.

Coupling 38 and cross coupling 48 can be threaded in conjunction with pipe segment 40, post assembly straight pipe 30, or post assembly arch pipe 28 also being threaded, so they can be screwed in to each other for an extra hold. However, having no threading is possible as well if the consumer was in a hurry and didn't have time to screw in all the components and didn't mind not having the extra hold. If no threading is used, the components literally just plug into each other like a round peg in a hole.

If no threading is used for coupling 38, specialized pvc glue would provide a tighter hold.

There can be more components used at any time to add support for heavier weather conditions or less components in mild climates to save money on the extra components.

The size of this invention or it's components can always be made bigger or smaller depending on individual or general consumer need.

Long connecting strap 26, seen in FIG. 2 can not only be bolted onto segments of base leg 10, an alternative method of attachment is to stitch in loops at each end of long connecting strap 26 so they can slide onto segments of base leg 10 and still maintain the same hold without leg to leg connector 12.

Another method of attachment of long connecting strap 26 is to have a clamp on each end that clamps and holds long connecting strap 26 to segments of base leg 10.

Long bolt 14 can not only be bolts that screw into segments of base leg 10, they can simply be rods that aren't threaded and have a flat end similar to the head of a nail. This alternative device could have it's flat head resting on the ground and the rod can be inserted through segment of base leg 10. This would simply eliminate having to screw it in. In addition, if this alternative method were used, the rod could be held firm from slipping out of segment of base leg 10, by having a pin that goes through the rod or a clamp that goes on the rod opposite the side of the flat head.

Pipe segments 40 in FIG. 10C could be made of smaller diameter than the arches on the dome in the same FIG. Although all the components of this invention can be varied in size, this alternative size of pipe segments 40 is only listed as one specific use of a variation in size because it came to mind.

Slit 52 can also be varied in length depending on how big the consumer wants their opening.

Anther alternative method is to use loop screws 34 instead of short bolt 18 and washer 20. This means attaching bendy hinge 16 with loop screw 34 rather than using bolts and washers. This would also change the location of loop screw 34 from being on the side of segments of base leg 10 and instead being on the top of base leg 10.

Another alternative is to have multiple openings in the dome in FIGS. 10 to 10C. This would mean having more than one slit 52.

The dome could also be used as a children's playpen by adding colors to circular tarp with slit 50 and or see through plastic windows.

In FIG. 6A, covering 24, after folding inward to create a closure, can be tied off any where on the "instant boat garage" including but not limited to the outside or inner frame.

The length of covering 24 can be the same length as the shelter. This however would create a shelter with two opened ends but it could save money if closed ends aren't needed.

ADVANTAGES

From the previous descriptions, many advantages of the "instant boat garage" become evident:

a) A base that bends around the earth's terrain so an instant boat garage can sit on uneven earth with little or no rocking.

b.) Any combination of entrances and exits or openings and closings can be formed with a one-piece tarp.

c.) There are no obstacles blocking either opening on each end of the shelter and so both sides can be entered and exited.

d.) Since the quantity, size, and positioning of all components of the instant boat garage are variable, the customer has a choice on how many structural support components he or she wants depending on wind speed and other climatic factors in his or her region.

e.) The instant boat garage is free standing without having to dig anything into the ground to hold the arches in their place.

f) There are no cross pipes that run along the ground which a vehicle would have to hop over.

g.) Straps made out of nylon or a similar materiel are used, rather than wire that can rust, to hold the arches in place and keep both legs of the base parallel in order to form a free standing arched tunnel.

h.) The inside of the shelter is made out of components that make it difficult to scratch paint off a vehicle in the event the vehicle accidentally brushed the shelter's inside.

i.) The shelter is made from parts that can simply be screwed apart into segments or taken apart easily so a customer could relocate with little hassle of cramming long components into a vehicle that just won't fit.

j.) Almost all the components of the shelter can be readily found on the market and so the manufacturing of the instant boat garage would be easier.

k.) If a part on the shelter breaks or needs replacement, most likely the customer would be able to find that component on a local market rather than having to order a specialized part. This would save the customer time and money.

l.) If a customer needed two or more instant boat garages, he or she could purchase two or more and connect them side by side to make a two or more car or boat garage.

m.) Since the shelter is made up from a plurality of segments, its size can be customized whenever the customer might need it. The size can be made custom by either adding or subtracting segments. The width of the arches can be reduced by shortening the straps that span the bottom or the width of the arches can be increased by investing a minimal amount to obtain longer straps.

n.) The shape of the shelter can be reconfigured from the preferred embodiment into whatever creative shape the customer needed. This would be possible by simply making the segments that make up the base in the shape of base he or she wants. Then using the same attachment method of the preferred embodiment a different shape could be made.

o.) Although it isn't shown in the FIGS, weigh down devices could be attached to help the shelter from blowing off in high winds.

OPERATION

FIG. 1 is a side view of one of the legs of the shelter. The leg is made out of a hard material that won't rot. The preferred materiel to use is Trex. Trex is meshed wood and plastic compacted together. It can also be drilled into in the same fashion as wood. The entire leg in FIG. 1 is made up by several segments of base leg 10 linked together. The entire leg is divided into segments to make the legs bendable to conform to the terrain. Moreover, they make the product easy to relocate and ship. Bendy hinge 16 is used at each point segments of base legs 10 come together. Bendy hinges 16 are connected at the top twice and the bottom of the leg once in FIG. 1. Bendy hinge 16 that is placed on the bottom of the base leg will enable those two segments of base leg 10 it hinges to bend over a hill or mound. Conversely, bendy hinges 16 attached on top the base leg will enable those segments of base leg 10 it links to bend so they sink into a groove or rut. Leg to leg connector 12 can also be seen in FIG. 1. This component is used to attach each long connecting strap 26, seen in FIG. 2, that connects the two base legs. Leg to leg connector 12 uses the same parts as bendy hinge 16. Again, leg to leg connector 12 is simply a bolt or screw, and a washer. Also in FIG. 1, long bolts 14 are drilled into each segment of base leg 10. The purpose of long bolts 14 is to hold the arches stable. The arches are held stable by sliding the hollow of each post assembly arch pipe 28, seen in FIG. 3, onto long bolts 14.

FIG. 1A shows a detailed illustration of two segments of base leg 10 hinged together by bendy hinge 16. The middle of bendy hinge 16 is where the ends of two segments of base leg 10 come together. In this illustration, bendy hinge 16 is placed on top one of the base legs and so this bendy hinge 16 will allow that point on the base leg to bend down into a groove or rut. Conversely, if bendy hinge 16 were placed on the bottom of the base leg, the point of connection could bend up and conform around a hill.

FIG. 1A shows all the components of bendy hinge 16. Short connecting strap 22 is a short strap that is made from nylon in the preferred embodiment. Short connecting strap 22 goes across where the two ends of segments of base leg 10 are placed together. To hold short connecting strap 22 in place, short bolt 18 and washer 20 are used on each segment of base leg 10. Short bolt 18 is screwed into a pre-drilled hole in segment of base leg 10. To enhance short bolts 18 hold on short connecting strap 22, washer 20 is slid into short bolt 18 before screwing it in.

FIG. 1A also shows two long bolts 14 drilled directly down into each segment of base leg 10. As mentioned before, long bolt 14 will hold the pipes that form the arches.

FIG. 2 is a top view of the base legs connected together by long connecting straps 26. Long connecting straps 26 prevent the base legs from moving out of position after post assembly arch pipes 28 are added. Long connecting strap 26 is made out of a tough bendable materiel like nylon. On end of long connecting strap 26 is bolted or screwed on one base leg. The other end is connected to the other parallel base leg in mirror fashion. Long connecting strap 26 is flat so a tire can run over it with out any problem. Leg to leg connector 12 is short bolt 18 and washer 20, in FIG. 1A, that holds each end of long connecting strap 26 secure to the base legs.

Long bolt 14 can be seen in FIG. 2 as small dots that look like rings. Long bolt 14 is a bolt that points to the sky perpendicular to the base legs. As will be shown in following FIGS, post assembly arch pipes 28 will be slid over one long bolt 14 on one base leg and then bend over and slid onto another mirroring long bolt 14 on the other leg. Two mirror long bolts 14 on opposite base legs will firmly hold one bent post assembly arch pipe 28 in place.

Bendy hinges 16 can be seen in FIG. 2. Bendy hinge 16 can be seen in detail in FIG. 1A. In FIG. 2 bendy hinge 16 is seen from a distance as what looks like two dots in two squares. A close look would show the line connecting these two squares is dotted. The dotted line represents where bendy hinge 16 typically bends. Bendy hinge 16 is made out of short connecting strap 22 that is made out of a strong bendable materiel such as nylon. Bendy hinge 16 connects two segments of base leg 10 together at each end using two short bolts 18 and two washers 20. More short bolts 18 and washers 20 can be used if the customer feels a condition where he lives would require more strength than average. Short bolt 18, washer 20, and short connecting strap 22 can be seen in FIG. 1A. Although they appear in FIG. 2, the numerals aren't seen, as it is more important to view bendy hinge 16 as a whole.

Several segments of base leg 10 are seen in FIG. 2. All segments of base leg 10 are connected at each end by bendy hinge 16 to form two base legs. The ends of each base leg don't need bendy hinge 16 as there is no more segments of base leg 10, however, more can be added to increase the shelters length.

FIG. 3 is the same as FIG. 2 with post assembly straight pipes 30, post assembly arch pipes 28, and end caps 32 added. Since FIG. 3 is a top view, the arches appear to be straight lines. Post assembly arch pipe 28 is slid over long bolt 14, bent over and slid onto the mirroring long bolt 14 on the other leg. Two long bolts 14 hold post assembly arch pipe 28 in the form of an arch. Long bolts 14 are hidden in FIG. 3 because they are inside post assembly arch pipes 28. Long connecting straps 26 hold the two base legs from flailing outward given the strain of the bent post assembly arch pipes 28.

Straight pipes 30 can also be seen in FIG. 3. Straight pipe 30 is used to keep all the arches locked into position. The amount of straight pipes 30 used is variable and depends on customer need depending on what type of climate he or she lives in. Straight pipes 30 are merely seen in FIG. 3 and not connected to the shelter. Criss cross connectors 36 will be seen in later FIGS. That aside, end caps 32 can be seen at each end of post assembly straight pipes 30. End caps 32 are used so that post assembly straight pipes 30 can't slide out of position horizontally. All other numerals in FIG. 3 have already been elaborated on and will further be expanded on when they need to be emphasized in later FIGS.

FIG. 4 is a detailed view of a comer of the "instant boat garage." FIG. 4 shows two segments of base leg 10. These two segments of base leg 10 are conjoined by bendy hinge 16. The dotted line in the middle of bendy hinge 16 is where bendy hinge 16 mostly bends.

Also in FIG. 4, post assembly straight pipe 30 is connected to post assembly arch pipe 28 by criss cross connector 36. Criss cross connectors 36 hold post assembly straight pipes 30 to post assembly arch pipes 28 by criss crossing criss cross connector 36 over each intersecting point.

End cap 32 can be seen in FIG. 4 as well. End cap 32 would prevent post assembly straight pipe 30 from sliding out of position. End cap 32 does this because it is wider than post assembly straight pipe 30 and wouldn't be able to slide through criss cross connector 36.

Two loop screws 34 can be seen in FIG. 4. Loop screws 34 are run all along the outer side of the base legs. Loop screws 34 are used to provide stable holes to thread rope through in conjunction with the rivets in the tarp. If loop screws 34 are threaded properly, the tarp shouldn't fly off with a strong wind. This will be shown in later FIGS. Loop screws 34 can also be used to tie in two or more "instant boat garages" side by side. The tie in device can easily be done with rope enabling the customer to have an inexpensive way to have two or more car garages.

FIG. 5 illustrates a complete skeleton of an "instant boat garage" from an angular side view. In FIG. 5 post assembly arch pipes 28 can be seen in their arched form. However, post assembly arch pipes 28 are labeled as several pipe segments 40 connected by couplings 38. Pipe segments 40 literally just plug into couplings 38. Specialized pvc glue would provide a stronger hold but isn't necessary. Pipe segments 40 seen at the end of each arch are slid on to long bolts 14. Although long bolts 14 are numbered in FIG. 5, they remain unseen as they are inside the ends of each arch. Post assembly arch pipe 28 is entitled "post assembly" because it is referring to pipe segments 40 that form an entire pipe after assembly. Post assembly straight pipes 30 can be assembled in the same manner. However, FIG. 5 does not show post assembly straight pipe 30 broken into pipe segments 40. The reason for this is to show that segments can be used to form any length pipe, or an entire pipe could be used without segments. The reason to use segments is to always be able to change the size of the shelter by adding or subtracting segments. Segments also make the shelter easier to deliver and move because they can be broken down. A whole pipe might be used if the customer plans on not relocating or lives close enough for a delivery of that size. Whole pipes are there also if possible so the customer can save time piecing together segments.

Also in FIG. 5 criss cross connector 36 is firmly fastened at each intersecting point of post assembly straight pipe 30 and pipe segments 40. End caps 32 prevent post assembly straight pipes 30 from sliding out of position horizontally. Post assembly straight pipe 30 should be firmly locked into place if fastened properly and slippage shouldn't happen horizontally or vertically. However, even if post assembly straight pipe 30 weren't fastened tight enough, end caps 32 should also help stop vertical slipping down the arch. The way this works is if one end of post assembly straight pipe 30 started to creep down the arch and the other end was fastened properly, end caps 32 would be angled against each arch and the one side would't be able to drop any lower.

Referring to FIGS. again, before post assembly straight pipes 30 and criss cross connectors 36 are added in assembly, the "instant boat garage" should be placed on top the terrain it will be used on. IF this is done prior to adding post assembly straight pipes 30, segments of base leg 10 will bend at each bendy hinge 16 to form fit the terrain. When segment of base leg 10 bends, the arch or arches connected to it will no longer point up directly perpendicular to flat earth. This might cause the arches to not be lined up when post assembly straight pipes 30 are attached. This would prevent criss cross connector 36 to be attached at each intersecting point. However, since pipe segments 40 or post assembly arch pipes 28 are bendable, they can be bent over or up to post assembly straight pipes 30 so they are touching. Then each intersecting point can be locked into that position, since they are touching, using criss cross connectors 36. Post assembly straight pipes 30 are put on last so they can lock the frame of the "instant boat garage" to form fit the terrain. Once every intersecting point is locked into position, the "instant boat garage" will maintain its shape around the contours of the earth or what it sits on.

Also in FIG. 5, long connecting straps 26 are attached to each base leg by leg to leg connectors 12 to further lock the "instant boat garage" into it's form fit position. With long connecting straps 26 firmly attached to each base leg, pipe segments 40 that make up post assembly arch pipes 28 will be prevented from bending back into their original straight form. Also, if all long connecting straps 26 are the same length, the two base legs will run parallel and create uniformity along the arch.

FIG. 5A shows two pipe segments 40 connected by coupling 38 in detail. Coupling 38 is a hollow tube just wider than pipe segment 40. Coupling 38 is threaded on the inside in conjunction to the threading of pipe segment 40 on each of its ends. Consequently, pipe segments 40 can be attached by screwing them into coupling 38.

FIG. 6 is covering 24 lined with rivets 42. Covering 24 can be any type of materiel. A customer might go with a cheap plastic materiel if he wants to save money and feels that's all he needs for where he lives. On the other hand, a customer might prefer a higher investment nylon materiel if he lives in a drastic climate and needs a heavy-duty tarp for major snow and hail storms. Covering 24 is laid over the skeleton and provides protection for what's inside. Rivets 42 are used to tie covering 24 into locked position.

FIG. 6A shows the skeleton of the "instant boat garage" with phantom lines under covering 24. Although a rope isn't seen, it is used to thread rivets 42 to loop screws 34. Loop screws 34 are illustrated as small rectangular markings along the closest base leg. They are labeled with a number in FIG. 4 and FIG. 5 but remain too small to properly label in FIG. 6.

At this point, covering 24 will hang to the ground on each end of the skeleton. However, FIG. 6A shows how far covering 24 would extend out if it were straightened. So only rivets 42 that are found within the base legs are threaded to loop screws 34 at this stage of the process. Rivets 42 outside of the base legs aren't used at this point. This leaves the customer the option to create two openings, an opening and a closing, or two closings at the entrance and exit of the "instant boat garage." The left side of FIG. 6A contains a C shaped two ended arrow that illustrates the folding of covering 24 to create a closing. After covering 24 is folded inward, like wrapping a Christmas present, rivets 42 on the piece of covering 24 outside the base legs could be used with additional roping that will connect to the frame and hold the folds in place to create an enclosure. On the other hand, the right side of FIG. 6A has a two-ended arrow that illustrates the proper fold to create an opening. A line also runs down covering 24 on the right side of FIG. 6A which shows where covering 24 should be folded back. Since covering 24 is the same width all around as it is rectangular, covering 24 could be folded back to form fit over the "instant boat garage" and create an opening. Rivets 42 outside the base legs in FIG. 6A will then be folded back to line the rivets on the inside of the base legs in FIG. 6A. Then a tie-in device could be used to hold the fold by running it through rivets 42 and loop screws 34 in addition to rivets 42 and loop screws 34 that should already be tied-in in the middle of covering 24. This would prevent the part of covering 24 that is folded back to create an opening, from flapping in the wind.

FIG. 7 is a front view of two preferred embodiments of the instant boat garage linked together side by side. Post assembly arch pipes 28, segments of base leg 10, and long connecting strap 26, are used in the same fashion as mentioned prior. However, the inner loop screws 34 that can be seen in FIG. 7 are not only used to tie down covering 24, shown later in FIG. 9, but also used in FIG. 7 to attach two shelters side by side using dual shelter attachment 44. Dual shelter attachment 44 is rope tied in a firm knot that will produce a strong hold.

FIG. 7A is the section of FIG. 7 where the two shelters are adjoined. Segments of base leg 10, and long connecting straps 26, are used in the same fashion as described in earlier FIGS. The point of focus in FIG. 7A is a detailed view of loop screws 34 held together by dual shelter attachment 44, as described in FIG. 7, to hold two preferred embodiments of the instant boat garage in a juxtaposing position.

FIG. 8 is a sectional top view of where the two shelters meet in FIG. 7 and FIG. 7A. Some components aren't shown in FIG. 8 to put the emphasis on the connecting points of the two shelters. However, segments of base leg 10, bendy hinges 16, and long connecting straps 26, are illustrated to help the reader follow the general relation of all the components. Loop screws 34 from the two opposite shelters are lined up so the shelters sit side by side. Dual shelter attachments 44 securely hold the shelters together so a customer could have a two or more car garage.

FIG. 9 is a section of the side of the preferred embodiment of the instant boat garage. Covering 24 is attached to the frame by using tarp tie down rope 46 to thread through rivets 42, on covering 24, in conjunction with loop screws 34, on segments of base leg 10. After tarp tie down rope 46 is threaded as shown in FIG. 9, it can be tightened and tied off anywhere stable on the shelter to keep a firm hold.

FIG. 10 is a top view of a dome made out of virtually the same components of the preferred embodiment in a different configuration. Segments of base leg 10 are held together in the form of an octagon approximately 45 degree angles by bendy hinges 16. Bendy hinges 16 can also be placed on the bottom of segments of base leg 10 to create a custom fit over various types of terrain as in the preferred embodiment. Post assembly arch pipes 28 are connected to long bolts 14 that are hidden in FIG. 10 because they are inserted in post assembly arch pipes 28 as in the preferred embodiment. Each post assembly arch pipe 28 starts in the middle of a segment of base leg 10 and bends over to the mirror opposing side inside the octagon. Each post assembly arch pipe 28 is met in the middle of the arch by cross coupling 48. Each cross coupling 48 holds pipes like coupling 38 but it has four ends as opposed to only two.

FIG. 10A is a detailed sectional view of the middle of FIG. 10. FIG. 10A illustrates cross coupling 48 holding four pieces of post assembly arch pipe 28. Referring back to FIG. 10 it is illustrated that two cross coupling pipes can hold eight pieces of post assembly arch pipe or four actual whole arches, pipe segments 40 not illustrated can be the pieces that make up an entire arch as used in the preferred embodiment in FIG. 5. By having cross couplings 48 makes it easier to assemble the dome shape by creating only two layers of post assembly arch pipe 28 in FIG. 10 at the tip of the arches as opposed to using only two ended couplings 38 that would make it inevitable to pile up the arches on several different layers.

FIG. 10B is what custom fits the shelter of the dome in FIG. 10 to help protect what's being stored inside the dome. It can be used as a substitute for covering 24 if the customer wants a more custom fit for a dome. Circular tarp with slit 50 takes the form of a circle so that it can fit evenly around the base of the dome in FIG. 10. Circular tarp with slit 50 is placed on top the dome and it's outer edges meet the base where rivets 42 are tied off on loop screws 34, as illustrated in FIG. 9 of the preferred embodiment, not shown in FIG. 10. Slit 52 can be placed over an opening in the frame to create a door. Similar to the preferred embodiment, to make an opening or closing, slit 52 can be tied off with additional tarp tie down rope 46.

FIG. 10C is a top view of FIG. 10 with added pipe segments 40. Pipe segments 40 are attached in the form of a cross that fills the gap between each arch. The one gap that isn't filled is the door. The newly added pipe segments 40 are held on by criss cross connectors 36 in the same fashion as the preferred embodiment. Bendy hinge 16 is labeled only to illustrate FIG. 10C is the same as FIG. 10. Not all pipe segments 40 and criss cross connectors 36 are labeled because it would clutter the picture. However the parts that are labeled look the same as the parts that aren't labeled and so it should be assumed they are the same. The reason pipe segments 40 are attached to the dome to fill the gaps between arches is that if the gap is not filled, circular tarp with slit 50, seen in FIG. 10B, will tend to droop inside the dome. Even though circular tarp with slit 50 could droop inside the dome if the gaps between the arches aren't filled, it is not so significant where it would prevent usage of the dome without the gaps being filled.

FIG. 11 is a dome made from the same components as the preferred embodiment with a variation on covering 24 and coupling 38. These variations can be seen in FIGS. 10, 10A, and 10B as circular tarp with slit 50 and cross coupling 48. FIG. 11 doesn't label or show all the detailed components but rather the basic shape as it would be redundant since the dome is made like the preferred embodiment. However, circular tarp with slit 50 and segments of base leg 10 can be seen in FIG. 11 to illustrate the basic relation of the domes components.

FIG. 12 illustrates the same form of attachment of two shelters as in FIG. 7. However, FIG. 12 shows a preferred embodiment and a dome made from the preferred embodiment of the instant boat garage, as opposed to the two preferred embodiments in FIG. 7. The parts labeled are post assembly arch pipe 28, segments of base leg 10, long connecting strap 26, circular tarp with slit 50, loop screws 34, and dual shelter attachment 44. Some components are left unlabeled and the parts labeled are labeled just to show a general relation of the components because the emphasis is on loop screws 34 and dual shelter attachment 44. Loop screws 34 where the shelters met are attached by dual shelter attachment 44 to hold the two shelters together as in FIG. 7. As in FIG. 7, dual shelter attachment 44 is rope tied in firm knots.

FIG. 13 is the same dome found in FIG. 12. Circular tarp with slit 50 and segments of base leg 10 are used in the same fashion. However, to avoid segments of base leg 10 partially blocking the opening, as in FIG. 13, long connecting strap 26 is used in place of one of the base legs and the opening is placed over it. FIG. 13 is a perfect example to illustrate how different components of the instant boat garage can be mixed and matched to construct many different forms, shapes, sizes, and uses of the instant boat garage.

FIG. 14 is the top view of the frame of an extended half dome constructed out of the same components of the preferred embodiment of the instant boat garage. Segments of base legs 10 are situated to form a partial octagon held together by bendy hinges 16. Additional segments of base leg 10 are added to give the partial octagon extended legs. As in the preferred embodiment, bendy hinges 16 can be placed on the top or bottom of segments of base leg 10 so the base can form fit over various terrain. The open end of the partial octagon is held in place by long connecting strap 26 which is connected and used in the same fashion as the preferred embodiment in FIG. 5. Additional long connecting straps are added for extra hold as long connecting strap 26 in the middle of the base illustrates. Post assembly arch pipes 28 form arches over the width of the partial octagon and are held in place by long bolts 14, not seen here, as illustrated in the preferred embodiment. More post assembly arch pipes 28 run from the butt end of the base to the tips of the arches and provide more stability to the arches. These post assembly arch pipes 28 are bent over from the back bottom to the front top of the shelter to intersect any post assembly arch pipe 28 that forms the arches. The end of these post assembly arch pipes 28 that start at the open end of the partial octagon are held from slipping backwards by end cap 32 in conjunction with criss cross connectors 36 that hold post assembly arch pipes 28 together at each intersecting point. The end of these post assembly arch pipes 28 that touch segment of base leg 10 at the butt end of the partial octagon are attached by long bolts 14, not seen here, in the same fashion as in the preferred embodiment. Stabilizer ropes 54 are tied to the post assembly arch pipe 28 that forms the arch at the open end of the shelter and are pulled back and tied off to segment of base leg 10. The reason for this is that this particular shelter has a tendency to lean forward because the post assembly arch pipes 28 that go from the back to the front of the shelter are bent and create a forward push.

FIG. 14A is the front view of FIG. 14. Post assembly arch pipe 28 that forms an arch in the front of the extended half dome is illustrated in FIG. 14A and held onto the front two segments of base leg 10 in the same fashion as the preferred embodiment. Also these segments of base leg 10 are held together by long connecting strap 26 in the same fashion as the preferred embodiment. The other segments of base leg 10 and post assembly arch pipes 28 are illustrated only in FIG. 14 as they should be shaded by circular tarp with slit 50 in FIG. 14A. Also the emphasis of FIG. 14A is on the opening as the other parts are already illustrated in FIG. 14. Circular tarp with slit 50 in FIG. 14A as seen in FIG. 10B can also fit the extended half dome. Loop screws 34 not illustrated in FIG. 14A can be utilized in the same fashion as FIG. 9. The other component illustrated in FIG. 14A is end cap 32 which holds post assembly arch pipes 28 from slipping as seen in FIG. 14. As mentioned prior, other components of the half dome are illustrated in FIG. 14 to emphasize that they are shaded with the addition of circular tarp with slit 50 in FIG. 14A.

CONCLUSIONS, RAMIFICATIONS, AND SCOPE OF INVENTION

Thus the person reading will observe that the invention of the "instant boat garage" offers a highly reliable, economical, easy to assemble, all terrain, safe, mobile device that can be used by anybody who owns boat or boats, car or cars, motorcycle or motorcycles, or just needs a shelter.

A benefit of the "instant boat garage" is that it's base legs can bend over the earths terrain. This makes it possible for anybody to shelter their car or boat even if they don't have flat ground to put an "instant boat garage." Also, rocking over uneven ground that can occur with other shelters is significantly absorbed.

Another advantage is that not only can a customer seal off both ends of the "instant boat garage" to protect the vehicle from all sides against weathering elements and the like, but any combination of open ends and closed ends could be arranged. Maybe a customer will use the "instant boat garage" to park her car into every night. In this case she can leave one end closed and the other open so she can pull her car in. Then she might want to close off the one open end for overnight protection. Some customers might have both ends open so they can easily pull in, store the vehicle over night, and pull out the other end when they leave. All this is done by using unique folds on only one tarp or covering.

A further beneficial factor is that the "instant boat garage" is designed with enough support that it doesn't require cross pipes or wires that might otherwise limit using only on end of the shelter as an entrance or exit.

The "instant boat garage" can also save the customer money. Not only does the customer save repair costs to the paint of his vehicle from otherwise not being properly protected, but he has a choice to invest more to make the "instant boat garage" stronger if needed. For example, in moderate climates, the "instant boat garage" doesn't really need as many arches or the pipes that support the arches and so investment on extra support isn't needed. However, in a more wind prone climate a customer could invest a little more to add more arches and the pipes that support the arches. Likewise, a customer might want to invest in more weigh down devices such as sand bags.

The other great thing about the "instant boat garage" is that it can always be added to. If the customer owns a 20 ft boat now, then upgrades to a 30 ft boat later, the arches can easily be made wider and the base legs can be made longer. Moreover, a customer could have a two-car garage by connecting one "instant boat garage" juxtaposing another one. He might use one for a boat and the other for a car. In addition he can add as many "instant boat garages" as needed.

One more great advantage is that the "instant boat garage" is stable by itself This means that no stakes or foundation has to be put into the ground. Besides, stakes don't work in soft soil because they slide out. Conversely, stakes can't be driven into rock or really hard ground.

Something else that's advantageous about the "instant boat garage" is that there is no cross pipes along the ground that a tire would have to hop over. This provides a nice smooth ride in and out of the shelter. A quick point to add to that is that instead of pipes or wires that go across the ground and get in a vehicles way. The instant boat garage uses flat straps that blend in with the earth's terrain. Besides, wires can rust and cause potential injury to a vehicle or a person.

Another point is that the interior of the "instant boat garage" is made fairly smooth so as to not cause damage to paint on a vehicle if the vehicle brushes the side of the shelter. A vehicles door is also protected if the driver threw it open against the side of the shelter.

Something else that is an advantage is that the "instant boat garage" can be easily disassembled or reassembled. This is possible because the shelter contains parts that can simply be unscrewed or taken apart by other easy means. This would make it easier on the customer if the customer had to move to a new residence.

Another advantage is that in the preferred embodiment of the "instant boat garage," the manufacturing would be easier because its components can be found readily on the market.

Additionally, in the preferred embodiment, if a part on the shelter breaks or gets lost, it can most likely be purchased in a local market. This way, a customer probably won't have to special order any parts. This could save time waiting on the delivery of the part a customer orders. If a customer went to the store to replace a part, extra shipping and handling charges could be saved. Also most of the components are fairly inexpensive.

One more advantage is that sand bags or weigh down devices could be used to add to the stability of the "instant boat garage." Such devices can be conveniently attached on the shelters base so in extremely high winds the shelter would keep from moving anywhere.

Furthermore, the "instant boat garage" holds additional benefits in that:

The customer can hinge the sections of base leg to custom fit the terrain;

Since in the preferred embodiment, the base legs are made from Trex, which is meshed wood and plastic, it won't rot or be subjected to termites;

The base legs can be drilled into, in the preferred embodiment, and so more components could always be added;

In the preferred embodiment, the base legs have a flat surface and give the shelter more stability;

In the preferred embodiment, the arches can keep their shape by merely sliding them onto bolts in conjunction with the straps that span the shelters width;

If the pipes that run horizontal on the shelter are put on last, the shelter will hold it's form fit over the earth's terrain;

Each end of the pipes that run horizontal is capped so they won't slide out of position;

Criss crossing connectors at each intersecting point of the pipes will keep the shelter's preferred form;

In the preferred embodiment the covering covers on all sides of the shelter so the vehicle inside is protected from weathering elements all around;

Thus, the invention's scope should be decided from the claims appended and anything legally equivalent, as opposed to the examples provided.

I claim:

1. A free standing shelter in the form of an arched structure that has the capability to lay on a flat surface and also bend around uneven terrain, comprising:

a pair of bases having plurality of base leg segments including a top and a bottom attached together by hinging means on the top or bottom of adjoining segments depending on requirements relative to the terrain, said hinging means made of a nylon strap using attachment means to connect onto the leg segments, each base further including a plurality of rods that stem upwards perpendicular from said base for attachment purposes, said bases are made of a material that is resistant to rusting and rotting and said base is made out of meshed wood and plastic, a plurality of connecting straps formed of an elongated essentially thin material connecting the bases together in a parallel manner, wherein said thin material is made out of woven thermoplastic the form of a nylon strap, a plurality of bendable pipe segments disposed upon said rods on each end forming curved ribs between the bases with the rods maintaining the ribs position and the connecting straps taut under the outward urging of the pipe segments, wherein each bendable pipe segment is comprised of a plurality of smaller segments that use means of attachment in the form of a coupling, a plurality of longitudinal support pipes juxtaposed underneath said bendable pipe segments to hold said curved ribs in a fixed position, wherein each support pipe can be broken into segments, wherein an end of each support pipe includes a wider element to stop said support pipe from sliding out of place, connective means to attach said bendable pipe segments to said support pipes defined as crisscrossing material positioned at each point where said longitudinal support pipes and said bendable pipe segments intersect, a covering in the form of a substantially thin flexible material disposed upon the bendable pipe segments and support pipes, wherein said covering can be used to form any combination of openings and closings in said shelter, and a plurality of loop screws distending outward from each base such that a number of shelters can be used as a portable garage by attaching one or more shelters side by side through the loops.

2. A free standing shelter in the form of an arched structure that has the capability to lay on a flat surface and also bend around uneven terrain, comprising:

a pair of bases having a plurality of base leg segments including a top and a bottom attached together by hinging means on the top or bottom of adjoining segments depending on requirements relative to the terrain, a plurality of connecting straps formed of an elongated essentially thin material connecting the bases together in a parallel manner, a plurality of bendable pipe segments disposed upon said bases on each end forming curved ribs between the bases for maintaining the ribs position and the connecting straps taut under the outward urging of the bent pipe segments, a plurality of longitudinal support pipes juxtaposed underneath said bendable pipe segments to hold said curved ribs in a fixed position, connective means to attach said bendable pipe segments to said support pipes defined as crisscrossing material positioned at each point where said longitudinal support pipes and said bendable pipe segments intersect, a covering in the form of a substantially thin flexible material disposed upon the bendable pipe segments and support pipes, wherein said covering can be used to form any combination of openings and closings in said shelter, and a plurality of loop screws distending outward from each base such that a number of shelters can be used as a portable garage by attaching one or more shelters side by side through the loops.

3. The free standing shelter as recited in claim 2 wherein an end of each longitudinal support pipe includes a wider element to stop said support pipe from sliding out of place.

4. The free standing shelter as recited in claim 2 wherein said hinging means is made of a nylon strap using attachment means to connect onto the leg segments.

5. The free standing shelter as recited in claim 2 wherein each base further includes a plurality of rods that stem upwards perpendicular from said base for attachment of the bendable pipe segments on each end.

6. The free standing shelter as recited in claim 2 wherein, said bases are made of a material that is resistant to rusting and rotting and said base is made out of meshed wood and plastic.

7. The free standing shelter as recited in claim 2 wherein said connecting strap thin material is a woven thermoplastic nylon.

8. The free standing shelter as recited in claim 2 wherein each bendable pipe segment is comprised of a plurality of smaller segments with fastening means for attachment.

9. The free standing shelter as recited in claim 8 wherein said fastening means for attachment of the bendable pipe segment is a coupling.

10. The free standing shelter as recited in claim 2 wherein each longitudinal support pipe can be broken into segments.

* * * * *